US007350595B2

(12) United States Patent
Sato et al.

(10) Patent No.: US 7,350,595 B2
(45) Date of Patent: Apr. 1, 2008

(54) DRILLING DEVICE AND DRILLING METHOD

(75) Inventors: Kusuo Sato, Tokyo (JP); Shigeru Mazaki, Saitama (JP); Toshio Imaoka, Yokohama (JP)

(73) Assignees: Mitsubishi Materials Corporation, Tokyo (JP); Nippon Diamond Co., Ltd., Kanagawa-Ken (JP)

( * ) Notice: Subject to any disclaimer, the term of this patent is extended or adjusted under 35 U.S.C. 154(b) by 203 days.

(21) Appl. No.: 10/478,756

(22) PCT Filed: May 17, 2002

(86) PCT No.: PCT/JP02/04788

§ 371 (c)(1),
(2), (4) Date: Sep. 10, 2004

(87) PCT Pub. No.: WO02/094527

PCT Pub. Date: Nov. 28, 2002

(65) Prior Publication Data

US 2005/0039951 A1 Feb. 24, 2005

(30) Foreign Application Priority Data

May 21, 2001 (JP) ..... 2001-151661
May 28, 2001 (JP) ..... 2001-159558
May 28, 2001 (JP) ..... 2001-159559

(51) Int. Cl.
*E21B 7/00* (2006.01)

(52) U.S. Cl. ..... 175/57; 175/195; 408/204; 408/1 R

(58) Field of Classification Search ..... 175/57, 175/162, 202, 195; 408/145, 204, 1 R; 125/20; 451/541; 29/26 A
See application file for complete search history.

(56) References Cited

U.S. PATENT DOCUMENTS 5,009,705 A * 4/1991 Yoshimura et al. ..... 75/240
5,065,647 A * 11/1991 Johnson ..... 76/108.6
5,174,691 A * 12/1992 Shepley ..... 408/1 R
6,102,135 A * 8/2000 Shaw ..... 175/20

FOREIGN PATENT DOCUMENTS

JP 61-146412 A1 7/1986
JP 3-3378 A1 1/1991
JP 4-26706 A1 3/1992
JP 5-318212 A1 12/1993
JP 2001-57757 A1 2/2001

* cited by examiner

*Primary Examiner*—William Neuder
*Assistant Examiner*—Nicole A Coy
(74) *Attorney, Agent, or Firm*—Darby & Darby P.C.

(57) ABSTRACT

A drilling device is composed so as to drill a drilled object composed of a brittle material with the end of a rotating core bit by using a core bit in which a bit, formed by dispersing and arranging a cemented carbide or super abrasive in a binder phase, is provided on the end of a cylindrical tube, and rotating the core bit around an axis with a direct motor. The drilling device is composed so that the core bit is rotated such that the peripheral velocity at the outer periphery of the bit is 300 m/min or more while the core bit presses against the drilled object at a pressure of 0.6 N/mm$^2$ or more during drilling.

7 Claims, 10 Drawing Sheets

DRILLING DEVICE AND DRILLING METHOD

BACKGROUND OF THE INVENTION

1. Technical Field

The present invention relates to a drilling device and drilling method for drilling holes in drilled objects composed of stone materials, bedrock or other typically brittle materials such as concrete, asphalt, granite and marble, and more particularly, to a drilling device and drilling method suitable for use when drilling tiles and joints of tiled walls or use when drilling concrete walls laid on the inner surfaces of tunnels, sewer pipes and so forth.

2. Background Art

A method for reinforcing existing concrete walls consists of first cutting out a large portion of the wall, providing an iron brace in the cut out opening and then reinforcing the entire wall by solidifying this brace and an anchor arranged on the inner peripheral surface of the opening with concrete. At this time, the anchor is arranged by containing in a hole provided in the inner peripheral surface of the opening.

The hole for arranging this anchor is formed as shown in FIG. 11, for example, by a drilling device provided with a core bit 80 (drilling tool), composed by providing a tip-shaped bit 80*a*, which is formed by dispersing and arranging a cemented carbide or super abrasive in a binder phase comprised by sintering a binder, on the end of a cylindrical tool body, and a motor 81 (rotary drive device) for rotating this core bit 80 around an axis.

Namely, during drilling, a drilled object in the form of concrete 82 is drilled by pressing bit 80*a* provided on the end of core bit 80 against concrete 80 while rotating to form a columnar core 83*a*. By then extracting core 83 after braking off base 83*a* of core 83 remaining inside concrete 82, a hole having a diameter of, for example, about 15-50 mm and depth of about 50-500 mm is formed corresponding to the diameter of core bit 80.

In addition, in order to prevent collapse of a concrete wall laid on the inner surface of a tunnel, a hole is drilled through this concrete wall to bedrock on the back side of the concrete wall, and a grouting material and so forth is injected through this hole between the concrete wall and bedrock to reinforce the concrete wall.

When drilling into a concrete wall, conventional rock drills, which drill holes in bedrock, are not used because the vibrations generated by the rock drill act to promote collapse, and in their stead, a drilling device as shown in FIG. 11 is similarly used to drill concrete structures. In this case, holes having a diameter of, for example, about 70-100 mm are drilled corresponding to the diameter of core bit 80.

In addition, in order to prevent separation of tiles accompanying dilapidation of structures having tiled outer walls, holes are drilled in the tiles and joints between tiles to form holes that reach to the underlying concrete wall, after which resin is injected behind the almost separated tiles through these holes to adhere the tiles to the concrete wall. A small impact drill for drilling concrete, for example, is used to drill holes in such tiles and tile joints.

However, since ordinary impact drills cause the drill to vibrate during drilling and drill while pounding the drilled object in the manner of a hammer, they conversely promote separation of the tiles resulting in the disadvantage of damaging the outer wall. Therefore, a drilling device is used that is provided with a drilling tool, in which a bit is provided on the end of a rod-shaped or cylindrical drill body, and a rotary drive device for rotating this drilling tool around an axis.

In the case of a drilling device of the prior art as shown in the drawing, a rotary shaft attached with a core bit is rotated by lowering the rotating speed with a gear and so forth in order to increase the generated torque obtained at a predetermined output power of the motor. The output power referred to here indicates the output power that can be extracted outside the motor but excluding the loss within the motor. Although this output power is decreased due to friction and so forth during the course of rotation being transmitted by a gear or other rotation transmission mechanism, it is ultimately converted to output power of the drilling device that rotates the core bit. This output power of the drilling device is then supplied for drilling holes.

Namely, if the sum of the force in the tangential direction applied to the end of the core bit due to resistance received from the drilled object during drilling is taken to be $F_t$, and the radius of the core bit is taken to be r, then the work required for making one revolution of the core bit during drilling can be expressed as $2\pi rF_t$. Therefore, when the core bit rotates $f_N$ per unit time, the power of the drilling device can be expressed as $2\pi rF_tf_N$. This relationship is more accurate if expressed as $2\pi rF_tf_N=vF_t$ since $r\omega$ is the peripheral velocity v at the outer periphery of the core bit. However, since $rF_t$ is the generated torque required for rotating the core bit, if this generated torque is taken to be T, then the output power of the drilling device can be represented as $P_{output}\propto Tf_N$ proportional to the product of rotating speed and generated torque.

In this manner, under conditions in which output power $P_{output}$ of the drilling device is a certain fixed value, in order to increase generated torque T, the rotating speed $f_N$ of the drilling tool is reduced by lowering the rotating speed of the motor with gears and so forth, even though transmission loss of the output power attributable to the gears is present.

A drilling device of the prior art as previously described had the shortcoming of slow drilling speed. Consequently, it invited the problems of prolonging the construction period and worsening the surrounding environment due to noise and vibrations generated during drilling.

For example, in the case of performing tunnel repair, a large number of holes having a depth of 500-1000 mm must be drilled. However, in the case of using a drilling device of the prior art, it takes about 30 minutes to drill a single hole, thereby resulting in the problem of requiring enormous construction costs in terms of labor costs alone to complete drilling of all the holes.

In addition, construction work has also recently been performed involving not only the concrete walls of tunnels, but also drilling holes in the concrete wall on the inner surfaces of sewer pipes followed by injecting a corrosion-resistant material behind the sewer pipes. In this manner, there has been a need to develop a technology suitable for drilling a large number of holes in a short period of time in concrete walls over long distances.

In addition, since drilling devices of the prior art as mentioned above drill holes while reducing the rotating speed of the drilling tool without using impact vibrations like those used in impact drills, they had the disadvantage of a slow drilling speed as compared with ordinary impact drills. There are cases in which nearly all of the tiles of outer walls are typically separated or beginning to be separated in the case of poorly constructed buildings and so forth. Since the task of completely removing all of the tiles and then reattaching them is actually quite bothersome, resin is ultimately injected behind all of the separated tiles. In this case, an extremely large number of holes must be drilled in the tiles. Consequently, there were the problems of a prolonged construction period and increased costs due to the increase in drilling time. In view of these reasons, there was a desire to develop a drilling device having low levels of vibrations capable of rapidly drilling holes comparable to impact drills and particularly without promoting separation of the tiles due to vibrations generated during drilling.

Therefore, the object of the present invention is to provide a drilling device and drilling method capable of drilling a drilled object in a short period of time by reducing the value of the work required to drill holes of a predetermined depth without waste.

DISCLOSURE OF THE INVENTION

The inventors of the present invention found that, when drilling by rotating a drilling tool provided with a bit formed by dispersing and arranging a cemented carbide or super abrasive in a binder phase on the end of a cylindrical tool body having a predetermined diameter while pressing against granite, marble or other stone material or bedrock with a predetermined pressure of 0.6 N/mm$^2$ or more, when the peripheral velocity of the bit on the end of the drilling tool is less than 220 m/min, the work required for drilling to a predetermined depth increases with the peripheral velocity of the bit, and the drilling speed cannot be effectively increased despite increasing the peripheral velocity of the bit, while also simultaneously finding that, when the bit peripheral velocity reaches at least 300 m/min, the amount of work required for drilling decreases, and drilling can be performed rapidly by increasing the peripheral velocity of the bit, thereby leading to completion of the present invention.

Namely, the present invention discloses a drilling device that has a drilling tool, in which a bit formed by dispersing and arranging a cemented carbide or super abrasive in a binder phase, is provided on the end of a rod-shaped or cylindrical tool body, and a rotary drive device rotating the drilling tool around an axis, and that is composed so as to drill a drilled object composed of a brittle material by pressing the end of the rotating drilling tool against the drilled object; wherein, the rotary drive device is composed so as to maintain the peripheral velocity at the outer periphery of the bit at 300 m/min or more while pressing the drilling tool against the drilled object at a predetermined pressure of 0.6 N/mm$^2$ or more during drilling.

In the present invention, a drilled object composed of concrete, asphalt, a stone material such as granite or marble, bedrock, tiles or the joints in between them or other brittle material is drilled using a drilling tool provided with a bit on the end of a rod-shaped or cylindrical tool body. In this case, when the peripheral velocity at the outer periphery of the bit is maintained at 300 m/min or more while pressing the end of the rotating drilling tool against the drilled object at a predetermined pressure of 0.6 N/mm$^2$ or more, the resistance received by the bit from the drilled object during drilling can be reduced, and the work required for drilling a hole of a predetermined depth (to also be referred to as the amount of drilling work) can be decreased. In this manner, the drilling speed can be increased by increasing the peripheral velocity of the bit.

The region between a bit peripheral velocity of 200 m/min and 300 m/min is the region in which the amount of drilling work rapidly decreases with peripheral velocity, and drilling speed basically begins to increase with the peripheral velocity of the bit when the peripheral velocity of the bit exceeds about 250 m/min. Consequently, if the drilling device is composed so that the peripheral velocity at the outer periphery of the bit is maintained at 250 m/min or more while pressing the drilling tool against the drilled object at a predetermined pressure of 0.6 N/mm$^2$ or more during drilling, drilling speed can be increased with an increase in peripheral velocity.

In addition, if the drilling device is composed so that the peripheral velocity of the bit is maintained at 400 m/min or more while pressing the drilling tool against the drilled object at a predetermined pressure of 0.6 N/mm$^2$ or more during drilling, drilling speed can be increased regardless of the type of drilled object composed of a brittle material.

Furthermore, since the bit breaks if pressed against the drilled object with excessive force, it is preferable to perform drilling at 6 N/mm$^2$ or less. More preferably, drilling can be carried out efficiently by drilling while pressing the bit against the drilled object at a pressure of about 3 N/mm$^2$.

In addition, it is preferable that drilling be carried out at a peripheral velocity of 2000 m/min or less. This is because, if the peripheral velocity of the bit is excessively high, the bearings and other components within the drilling device may be damaged, and particularly when rotating a cylindrical object at high speeds, dynamic balance increases which is potentially dangerous since it can lead to destruction of the object. In addition, differing from conventional drills, since spiral-shaped grooves and so forth are normally not provided on the outer periphery of the drilling tool, resulting in holes being drilled in the state in which the space between the walls of the holes and the drilling tool are occluded, when the peripheral velocity becomes high, it becomes difficult to release the heat generated by drilling through cuttings or through water, air or other coolants.

In addition, in the drilling device of the present invention, the aforementioned drilling tool may have a diameter of 3-200 mm. In a drilling tool of this diameter, drilling speed can be increased reliably.

In addition, in the drilling device of the present invention, the aforementioned drilling tool may have a diameter of 3 mm to no more than 15 mm. In a drilling tool of this diameter, drilling speed can be increased reliably particularly when drilling narrow diameter holes using a rod-shaped tool body.

In addition, in the drilling device of the present invention, the aforementioned drilling tool may have a diameter of 15 mm to no more than 50 mm. In a drilling tool of this diameter, drilling speed can be increased reliably particularly when using a cylindrical tool body.

In addition, in the drilling device of the present invention, the aforementioned drilling tool may have a diameter of 50-200 mm. In a drilling tool of this diameter, drilling speed can be increased reliably particularly when using a cylindrical tool body.

In addition, in the drilling device of the present invention, the aforementioned rotary drive device is provided with a tube-shaped rotor in which a rotating shaft, to which the aforementioned drilling tool is attached on its end, is integrally provided passing through it, and a cylindrical stator provided on the outer peripheral surface of the rotor.

In this manner, in the present invention, since a drilling tool is attached directly to the rotating shaft of a rotor without going through gears and so forth, work loss attributable to a rotation transmission system is eliminated, and the output power of the motor can be used directly as the output power of the drilling device. This also makes it possible to reduce the size and weight of the drilling device.

Furthermore, a force per unit surface area of at least about 0.2 $N/mm^2$ is required in the tangential direction to the bit during drilling. Consequently, in the case a bit having a cutting edge thickness of about 2 mm being provided continuously over the peripheral direction on the end of a drilling tool having a diameter of 15-200 mm, at least about 0.14-25 Nm of torque is required corresponding to the diameter of the drilling tool. Torque is also required corresponding to the surface area of the bit on the end in the case of a rod-shaped drilling tool having a diameter of 3 mm to no more than 15 mm. In order to maintain the peripheral velocity at 300 m/min or more in the state in which this torque is applied in the form of a load, one of either the rotor or stator that composes the motor is preferably composed to have a niobium-iron-boron-based or samarium-cobalt-based rare earth magnet, and the maximum magnetic energy product of this magnet is preferably 100 $kJm^{-3}$ or more. As a result, the torque constant of the motor can easily be increased to 0.1 Nm/A or more. This also makes it possible to reduce the size and weight of a direct current motor, while also enabling high-speed rotation while maintaining a high output.

In addition, a communicating hole that passes through from the rear end of the rotating shaft to the tool body on the front end may be provided along the axis in the aforementioned rotating shaft. As a result, a pushing rod for removing cores from the side of the rotating shaft can be provided, or water, air or other fluid can be fed out towards the end of the drilling tool.

Moreover, the power supply that supplies a direct current voltage to the motor may have a control section, and this control section may be composed so as to regulate the voltage applied to the direct current motor so that the required generated torque T and peripheral velocity are obtained by detecting generated torque T and rotating speed $f_N$. More specifically, if the voltage applied to the direct current motor is taken to be $V_M$, then the relationship of $V_M \cong K_T T + K_f f_N$ is valid between generated torque T and rotating speed $f_N$ (where, $K_T$ and $K_f$ are constants). In addition, if the current that flows to the direct current motor is taken to be $I_M$, then the relationship of $T \cong K_I I_M$ (where $K_I$ is the torque constant) is valid. By utilizing these relationships, the control section may then be composed so that it calculates generated torque T from the detected value of current $I_M$ based on a known characteristics curve of the motor, and calculates rotating speed $f_N$ from the value of the applied voltage $V_M$, or directly detects rotating speed $f_N$ with an encoder and so forth. For example, this control section may be composed so as to regulate the value of voltage $V_M$ so that the peripheral velocity of the drilling tool in the no-load state is a predetermined value of 300 m/min or more, control a drilling device feeding mechanism composed so as to feed the drilling device towards the drilled object, feed the drilling tool towards the drilled object at a predetermined pressure of 0.6 $N/mm^2$ or more, and simultaneous to applying torque to the drilling tool as a result of the end of the drilling tool beginning initial drilling of the drilled object, maintains the peripheral velocity of the drilling tool at a predetermined value of 300 m/min or more by regulating the value applied voltage $V_M$.

In addition, the present invention is also a drilling method for drilling a drilled object composed of a brittle material by rotating around an axis a drilling tool in which a bit, formed by dispersing and arranging a cemented carbide or super abrasive in a binder phase, is provided on the end of a cylindrical tool body, and pressing the end of the aforementioned rotated drilling tool against said drilled object; wherein, the drilled object is drilled by pressing the aforementioned drilling tool against the drilled object at a predetermined pressure of 0.6 $N/mm^2$ or more while maintaining the peripheral velocity at the outer periphery of the bit at 300 m/min or more.

In the present invention, as a result of maintaining the peripheral velocity at the outer periphery of the bit at 300 m/min or more in the state in which the drilled object is drilled by pressing the end of the rotating drilling tool against the drilled object at predetermined pressure of 0.6 $N/mm^2$ or more, the resistance received from the drilled object decreases, and the work required to drill a hole of a predetermined depth can be held constant at a low value. In this manner, the drilling speed can be effectively increased by increasing the peripheral velocity of the bit.

Furthermore, since the bit will be damaged if press against the drilled object with excessive force, it is preferable to perform drilling at 6 $N/mm^2$ or less. More preferably, drilling can be carried out efficiently by drilling while pressing against the drilled object at a pressure of about 3 $N/mm^2$.

In addition, it is preferable to carry out drilling at a peripheral velocity of 2000 m/min or less. This is because if the peripheral velocity of the bit is excessively high, the bearings and other components within the drilling device may be damaged, and particularly when rotating a cylindrical object at high speeds, dynamic balance increases which is potentially dangerous since it can lead to destruction of the object. In addition, differing from conventional drills, since spiral-shaped grooves and so forth are normally not provided on the outer periphery of the drilling tool, resulting in holes being drilled in the state in which the space between the walls of the holes and the drilling tool are occluded, when the peripheral velocity becomes high, it becomes difficult to release the heat generated by drilling through cuttings or through water, air or other coolants.

For example, the peripheral velocity of the drilling tool is first adjusted so reach a predetermined value of 300 m/min or more in the no-load state. As a result of then feeding the drilling device towards the drilled object at a predetermined feeding speed while rotating the drilling tool, and allowing the end of the drilling tool to begin initial drilling into the drilled object, simultaneous to torque being applied to the drilling tool, the output for drilling and the feeding speed are regulated to perform drilling while maintaining the peripheral velocity of the drilling tool at 300 m/min or more.

The region between a bit peripheral velocity of 200 m/min and 300 m/min is the region in which the amount of drilling work rapidly decreases with peripheral velocity, and drilling speed basically begins to increase with the peripheral velocity of the bit when the peripheral velocity of the bit exceeds about 250 m/min. Consequently, if drilling is performed with the peripheral velocity at the outer periphery of the bit maintained at 250 m/min or more while pressing the drilling tool against the drilled object at a predetermined pressure of 0.6 N/mm or more during drilling, drilling speed can be increased with an increase in peripheral velocity.

In addition, if drilling is performed so as to maintain the peripheral velocity of the bit at 400 m/min or more while pressing the drilling tool against the drilled object at a predetermined pressure of 0.6 $N/mm^2$ or more during drilling, drilling speed can be reliably increased regardless of the type of drilling object composed of a brittle material.

In addition, in the drilling method of the present invention, the aforementioned drilling tool may have a diameter of 3-200 mm. In this case, drilling speed can be increased reliably.

In addition, in the drilling method of the present invention, the aforementioned drilling tool may have a diameter of 3 mm to no more than 15 mm. In this case, drilling speed can be increased reliably particularly when drilling narrow diameter holes using a rod-shaped tool body.

In addition, in the drilling method of the present invention, the aforementioned drilling tool may have a diameter of 15 mm to no more than 50 mm. In this case, drilling speed can be increased reliably particularly when using a cylindrical tool body.

In addition, in the drilling method of the present invention, the aforementioned drilling tool may have a diameter of 50-200 mm. In this case, drilling speed can be increased reliably particularly when using a cylindrical tool body.

BEST MODE FOR CARRYING OUT THE INVENTION

Figure 1:
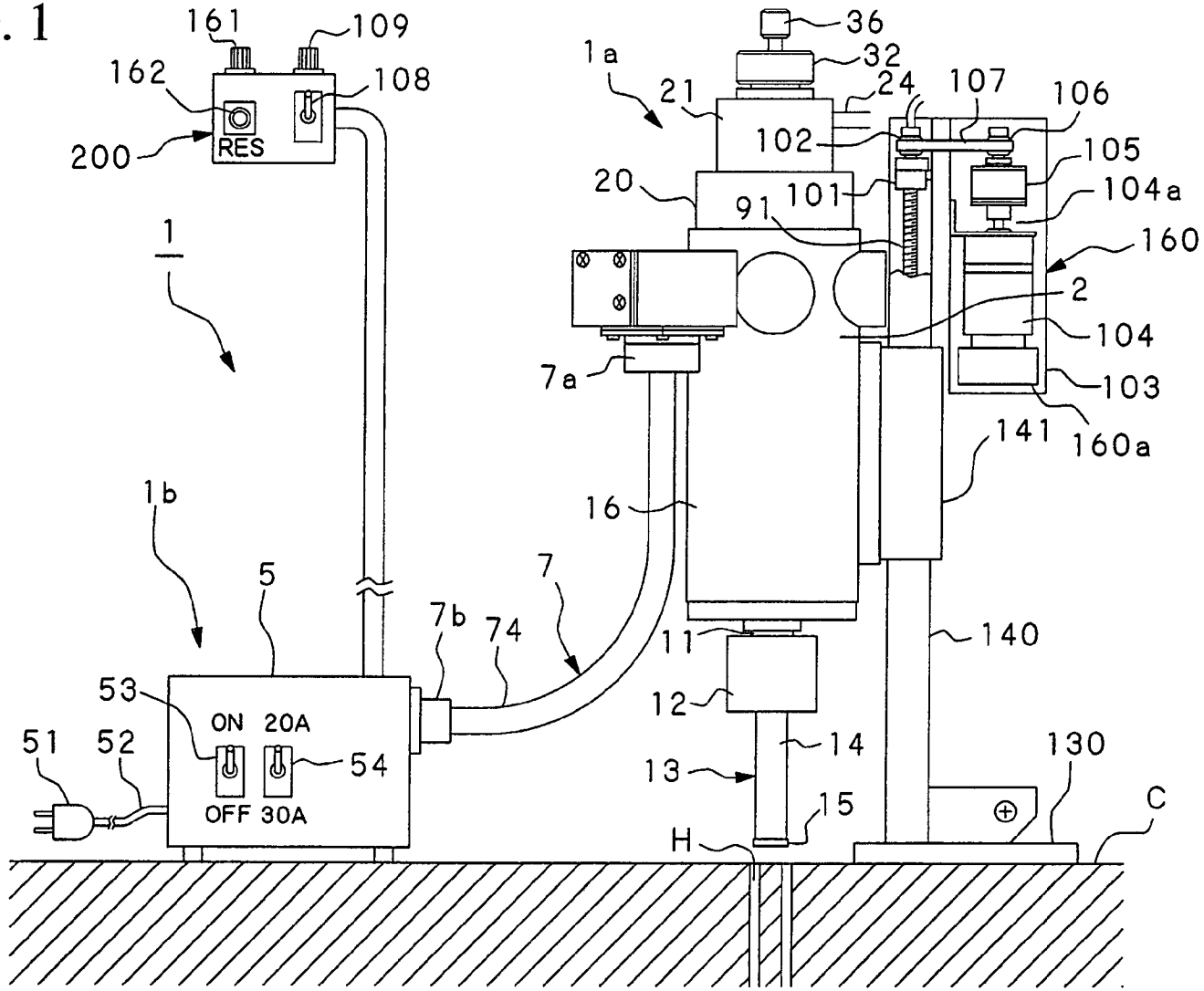
FIG. 1 is a lateral view showing an example of a drilling device as a first embodiment as claimed in the present invention.

The following provides an explanation of a drilling device according to the present invention based on the drawings.

FIGS. 1 through 5 show an embodiment of a drilling device as claimed in the present invention. Reference symbol 1 indicates a drilling device, 1*a* a drilling device body, 1*b* a power supply and reference symbol 2 indicates a direct current motor of the present embodiment that composes drilling device body 1*a* driven by this power supply 1*b* (to be referred to as a direct motor).

Drilling device 1 has installed section 130 installed on a drilled object C such as asphalt, concrete, a stone material such as granite or marble or bedrock, and a support column section 140 rotatably linked to this installed section 130 and able to be inclined with respect to installed section 130. Drilling device body 1*a* is provided separately from power supply 1*b*, and is supported by support column section 140 by means of a sliding mechanism 141 movably attached to support column section 140.

In addition, drilling device 1 is composed by providing a remote control section 200, which controls drilling device 1, separately from drilling device body 1*a* and power supply 1*b*. This control section 200 is provided with a speed adjustment knob 161 for starting or stopping direct motor 2 by adjusting the speed of direct motor 2 (rotary drive device), and a reset button 162 that resumes voltage output in the case the output voltage of power supply 1*b* has dropped to zero due to interlocking of the power supply.

Figure 2:
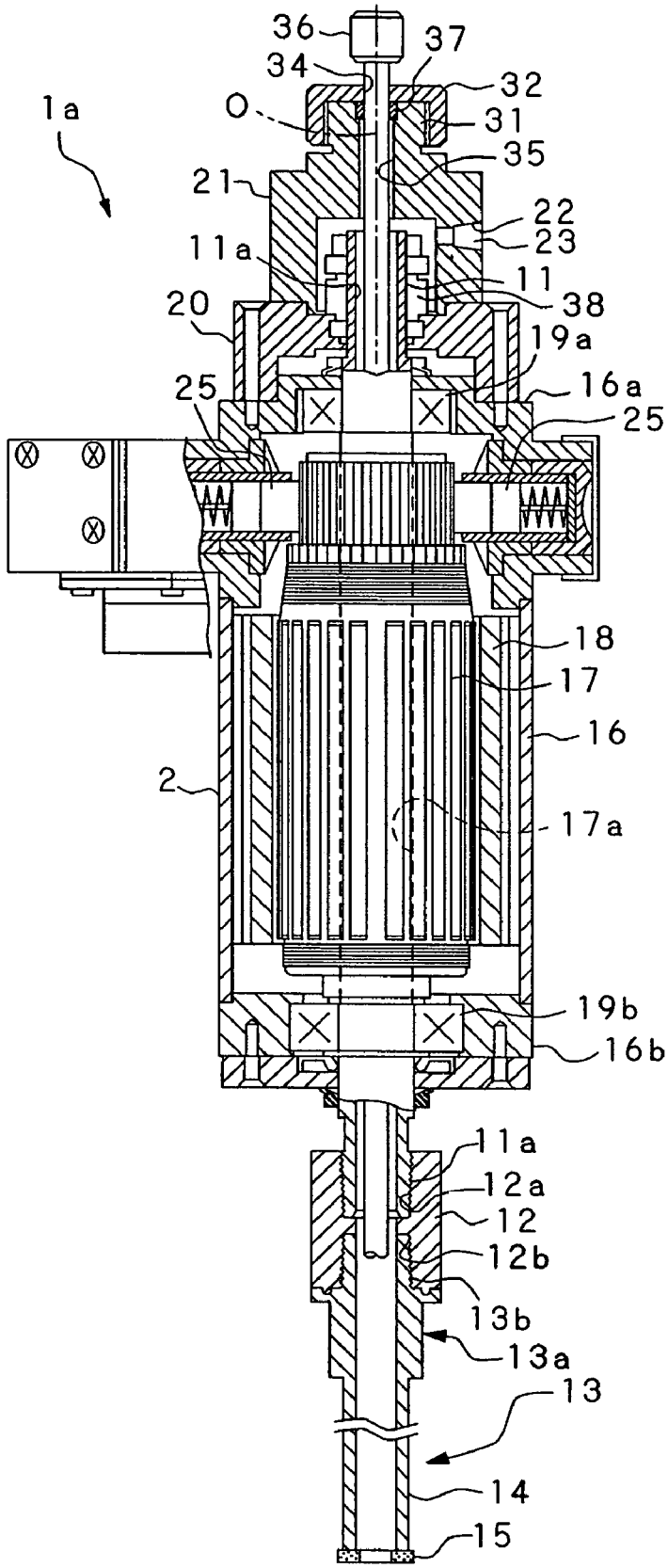
FIG. 2 is a partially cutaway lateral view showing a drilling device body of a drilling device as a first embodiment as claimed in the present invention.

Direct motor 2 is in the form of a direct current motor that rotates when a direct current voltage is applied, and as shown in FIG. 2, has a cylindrical rotating shaft 11 in its center, and on the end of this rotating shaft 11, an adapter 12 is removably screwed onto a threaded section 11*a* formed on the end of rotating shaft 11, and a cylindrical core bit 13 (drilling tool) is removably attached to this adapter 12 so as to form a through hole continuous with rotating shaft 11.

Here, adapter 12 has a roughly hollow cylindrical shape, and a female threaded section 12*a*, which screws onto threaded section 11*a* of the end of rotating shaft 11 is provided on its base end side, while a female threaded section 12*b*, to which is attached the base end of core bit 13, is provided along the direction of axis O of rotating shaft 11 on its front end. Here, female threaded section 12*a* is formed in the orientation in which it is fastened to rotating shaft 11 due to rotation during drilling.

In addition, core bit 13 is made to have a structure in which bit 15 is attached in a roughly ring shape in the circumferential direction on the end of a hollow tube 14 (tool body) formed in the shape of a cylinder having a diameter of 15-50 mm. Here, bit 15 is formed by dispersing and arranging a cemented carbide or super abrasive (diamond abrasive or CNB abrasive) in a binder phase composed by sintering and hardening a metal bond, resin bond or other binder material. Alternatively, in the case the drilled object is marble, bit 15 is formed by dispersing and arranging a super abrasive in binder phase by electrodeposition. Core bit 13 to which this bit 15 is attached to its end is composed so as to drill drilled object C and form a cylindrical core by being rotated around an axis and being fed towards the front end in the axial direction.

Removable section 13*a* attached to adapter 12 is provided on the base end side of this core bit 13. Male threaded section 13*b* that screws into female threaded section 12*b* of adapter 12 is formed on this removable section 13*a* along the axial direction of core bit 13. Here, male threaded section 13 is formed in the orientation in which core bit 13 is fastened to adapter 12 due to rotation of core bit 13 during drilling.

Direct motor 2 is a direct type of motor that directly rotates core bit 13, which is a tool directly coupled to rotating shaft 11, without using gears or other rotation transmission mechanism, and is composed so as to allow core bit 13 having a diameter of 15 mm to less than 50 mm to rotate at a peripheral velocity of 300-2000 m/min while being pressed against drilled object C at a pressure within the range of 0.6-6 $N/mm^2$.

In addition, direct motor 2 is composed of a rotor 17, composed by winding a coil coated with polyimide or other heat-resistant resin, and a cylindrical stator 18 provided around the outer peripheral surface of this rotor 17 and having a permanent magnet, within a housing 16. Rotating shaft 11 is inserted through insertion hole 17*a* formed in the center of the aforementioned rotor 17 so as to be press fit inside, and integrally fixed to rotor 17.

Here, a niobium-iron-boron-based or samarium-cobalt-based rare earth, high-density magnet is used for the magnet of stator 18 for the purpose of realizing small size, light weight and a high torque since the maximum magnetic energy product of 100 $kJm^{-3}$ or more is much higher than that of typically used ferrite magnets or alnico magnets. In addition, the diameter of rotor 17 is to be smaller than its length. As a result, the torque constant of direct rotor 2 in the present embodiment is 0.12 Nm/A, and the relationship of $T=0.12*I_M-0.6$ is valid between generated torque T (units: Nm) and current $I_M$ (units: A) flowing to direct motor 2 in the present embodiment.

Bearings 19*a* and 19*b* are respectively installed on the insides of upper wall section 16*a* and lower wall section 16*b* of housing 16 that houses direct motor 2 in order to rotatably support rotor 12. Namely, bearings 19*a* and 19*b* are made to support the vicinities of the upper and lower ends of rotating shaft 11 inserted through the center of rotor 17, and are composed so as to be able to receive force in the thrust direction and force in the radial direction that act on rotating shaft 11 and rotor 17 inserted through this rotating shaft 11.

A rotating shaft support stand 20, which rotatably supports mechanical seal 38 rotatably coupled in a liquid-tight state to the rear end section of rotating shaft 11, and an upper housing 21, which is fixed on rotating shaft support stand 20 and houses the rear end section of rotating shaft 11, are provided in the rear end section of this direct motor 2.

A flow path 22 that communicates with through hole 11*a* in the center of rotating shaft 11 is formed in this upper housing 21, and this flow path 22 opens on the side of upper housing 21. This opening 23 opened in the side allows the connection of tube 24, and cooling water for wet drilling is fed in from this tube 24.

The location drilled by bit 15 is then cooled by cooling water being fed from this tube 24 through flow path 22 of upper housing 21, led to through hole 11*a* of rotating shaft 11, and then fed into core bit 13 linked through adapter 12 to the front end section of rotating shaft 11.

In addition, a mounting threaded section 31 is formed in the rear end section of upper housing 21, and a cap 32 is fixed by screwing onto this mounting threaded section 31. This cap 32 has an insertion hole 34 formed in its center. In addition, a communicating hole 35 that communicates with insertion hole 34 of cap 32 and through hole 11*a* of rotating shaft 11 is formed in upper housing 21. A pushing rod 36 is inserted through these mutually communicating insertion hole 34, communicating hole 35 and through hole 11*a*. Furthermore, an O-ring 37 is provided between pushing rod 36 and insertion hole 34 of cap 32 to seal the space between them.

Furthermore, reference symbol 25 indicates a brush section arranged in the peripheral direction of rotating shaft 11 so as to contact rotating shaft 11 in the upper part of housing 16 of direct motor 2, and a direct current voltage is applied to this brush section 25 to supply drive current.

Power supply 1*b*, which supplies a direct current voltage to direct motor 2, has a power supply body 5, and is provided with an input cable 52 having a plug 51 for connecting power supply body 5 to an alternating current source supplied to the work site. In addition to a main switch 53, a current level selector switch 54 is provided on power supply body 5 that allows selection of a suitable current level corresponding to the allowable current level of the input power supply. Furthermore, although not shown in the drawings, a drilling work emergency stop switch and a cooling water inlet port for introducing cooling water for cooling the power supply are also provided on power supply body 5.

A cable 7 is provided between the aforementioned drilling device body 1*a* and power supply 1*b*. This cable 7 is composed of a single cable in which two current supply wires not shown, which supply direct current to direct motor 2 from power supply 1*b*, and a ground wire and so forth are bundled together by a waterproof cover 74 having moisture resistance, and is composed so that the current supply wires, ground wire and so forth can be integrally laid when transporting drilling device body 1*a*.

Moreover, a multi-wire drilling device body connector 7*a* is provided on one end of cable 7 on the side of drilling device body 1*a* so that the current supply wires, ground wire and so forth are integrally connected to drilling device body 1*a* while maintaining water-tightness, while multi-wire motor power supply connector 7*b* is provided on the other end of cable 7 on the power supply side so that the current supply wires, ground wire and so forth are integrally connected to power supply 1*b* while maintaining water-tightness. Waterproof cover 74 is attached to drilling device body connector 7*a* and motor power supply connector 7*b* while maintaining water-tightness, and is composed so that the current supply wires, lead wires for controlling the power supply and ground wire and so forth inside are protected from water even if cable 7 is immersed in water.

Figure 3:
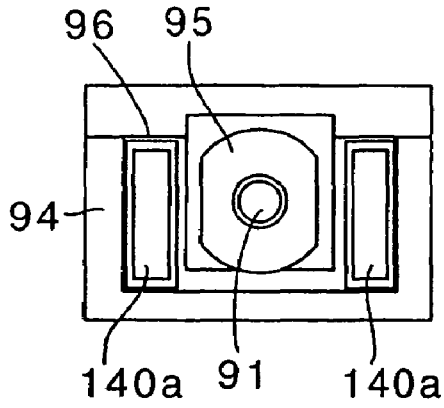
FIG. 3 is a cross-sectional view of a support column section for explaining the structure of the support column section of a drilling device of the present embodiment.

As shown in FIG. 3, support column section 140 is composed of a pair of long support column plates 140*a*, and a ball screw 91 is provided between these support column plates 140*a* over the lengthwise direction of support column section 140. This ball screw 91 is rotatably supported by bearings 101 provided in the vicinities of the upper and lower ends of support column section 140.

As shown in FIG. 3, a sliding mechanism 141, movably attached to this support column section 140, has a sliding box 94 provided so as to surround the periphery of support column plates 140*a*, and a sliding member 95 fixed to this sliding box 94 and into which ball screw 91 is screwed within sliding box 94. In addition, a sliding plate 96, which ensures a smooth sliding state for support column plates 140*a*, is provided between sliding box 94 and support column plates 140*a*. This sliding mechanism 141 is composed such that, when ball screw 91 is rotated, sliding box 94 slides with respect to support column section 140 together with sliding member 95 into which is screwed this ball screw 91, and the entire sliding mechanism 141 moves in the lengthwise direction along support column section 140.

The direction of this movement is determined by the direction of rotation of ball screw 91, and drilling device body 1*a* fastened to sliding mechanism 141 moves backward or forward relative to drilled object C depending on rotation in the clockwise direction or rotation in the counter-clockwise direction by ball screw 91 while being supported by support column section 140.

Figure 4:
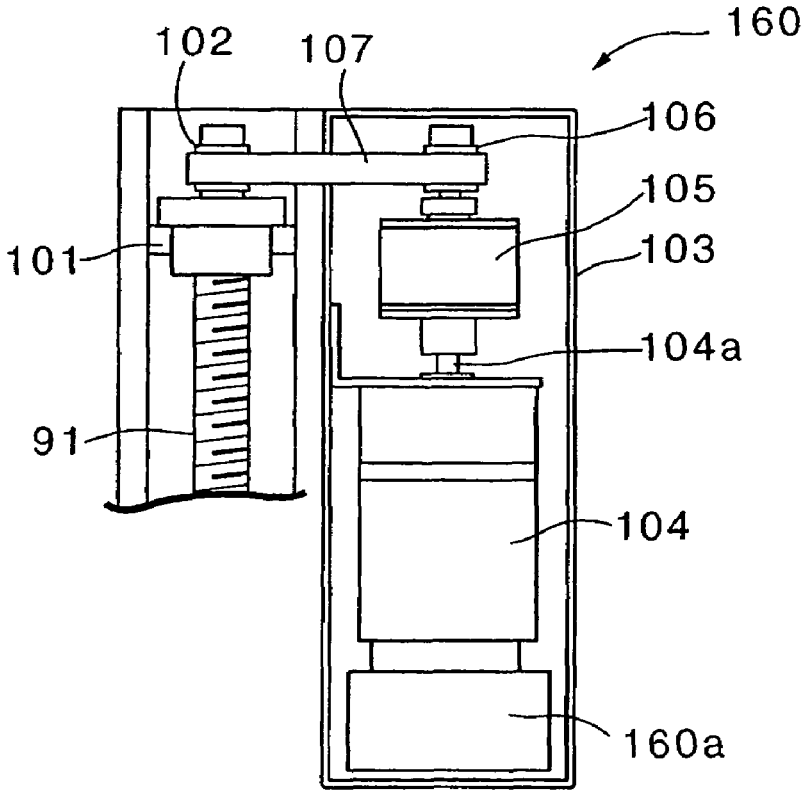
FIG. 4 is a cross-sectional view of a movement mechanism for explaining the constitution and structure of the movement mechanism of a drilling device of the present embodiment.

This ball screw 91 is rotated by a movement mechanism 160 (drilling device feeding mechanism) provided on the upper end section of support column section 140. Namely, as shown in FIG. 4, movement mechanism 160 has a movement motor 104 provided within housing box 103, and a drive pulley 106 is connected via a clutch 105 to rotating shaft 104*a* of this movement motor 104. A transmission belt 107 is wrapped around this drive pulley 106 and a driven pulley 102 fastened to the upper end section of ball screw 91, and the rotary driving force of movement motor 104 is transmitted to ball screw 91 by this transmission belt 107, resulting in rotation of ball screw 91. Here, clutch 105 provided between movement motor 104 of movement mechanism 160 and drive pulley 106 around which is wrapped transmission belt 107 serves as an electromagnetic clutch that links the corresponding shafts by a predetermined force due to the cohesive force of the magnetic particles generated by magnetic force.

In this manner, drilling device body 1*a* is moved along support column section 140 as a result of movement mechanism 160 driving the rotation of ball screw 91.

Furthermore, in addition to a ball screw, drilling device body 1*a* may also be composed so as to be driven by the combination of a rack and pinion.

Remote control section 200 is provided with a power switch 108 for switching on and off the driving of movement motor 104 of movement mechanism 160, and speed adjustment knob 109 that adjusts the rotating speed of movement motor 104, in order to control movement mechanism 160.

Figure 5:
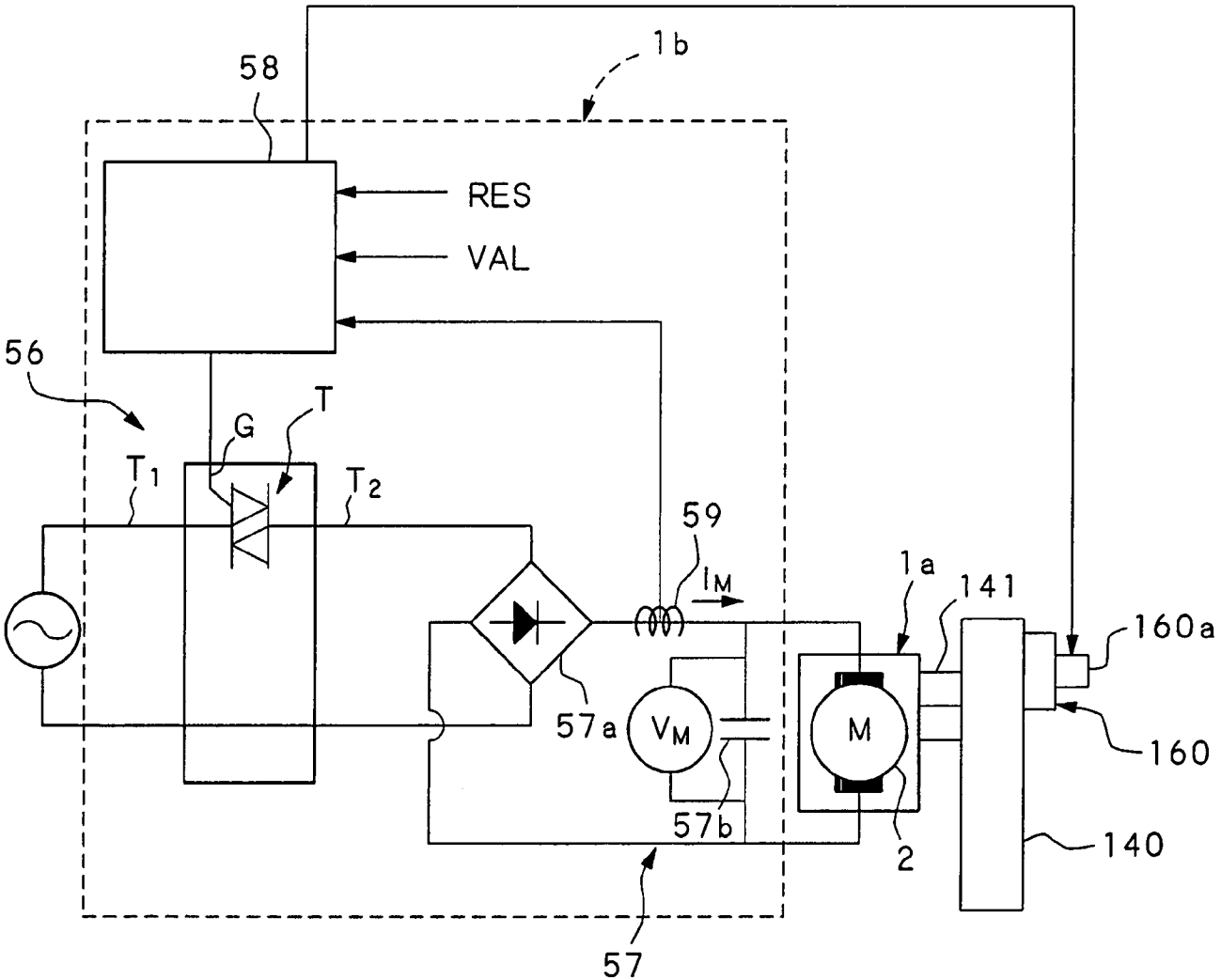
FIG. 5 is a block diagram schematically showing the electrical circuit connections of a drilling device of the present embodiment.

FIG. 5 shows a schematic block diagram of the electrical circuit configuration of drilling device 1. As shown in FIG. 5, power supply 1*b* is provided with phase control section 56, which periodically outputs a portion of the phase of the alternating current voltage on input side T1 to output side T2 by adjusting the firing angle of trigger current applied to gate G of triac T, and rectifier section 57, which smoothens the voltage pulsation by rectifying the voltage of output side T2 of phase control section 56 so as to apply a direct current voltage to direct motor 2.

Phase control section 56 has a power supply control section 58 (control section) that imparts a trigger current from, for example, a diac, to gate G of triac T, and is composed so as to control the output to output side T2 by suitably adjusting the firing angle of the trigger current based on the input from speed adjustment knob 161 (indicated with VAL in the drawing) and the input from reset button 162 (indicated with RES in the drawing) provided in remote control section 200.

Moreover, power supply 1*b* is provided with a current detector 59 that detects current $I_M$ that flows through direct motor 2, and has a motor drive voltage stopping means in the form of a breaker so as to immediately interrupt the output of voltage when the current value detected by current detector 59 exceeds a threshold value.

Rectifier section 57 is provided with a diode section 57*a* for full wave rectification of the output voltage of phase control section 56 such that a portion of the peak of a sine curve is cut away, and a condenser 57*b* electrically connected in parallel to direct motor 2 that smoothens voltage pulsation by rectifying the voltage. Moreover, rectifier section 57 is provided with a circuit not shown that allows the rapid discharge of accumulated charge from condenser 57 when direct motor 2 is stopped, and prevents direct motor 2 from resuming rotation due to this accumulated charge.

In addition, power supply 1*b* has a selector switch not shown for switching from manual control of the drilling device as described above to automatic control. When switched to automatic control, power supply control section 58 is composed to calculate generated torque T from the data of a known characteristics curve that is input into internally installed memory based on the detected current $I_M$ flowing through direct motor 2, and calculate the rotating speed of direct motor 2, or in other words rotating speed $f_N$ of core bit 13, by calculating voltage $V_M$, which is applied to direct motor 2, from the firing angle of the trigger current.

In addition, power supply control section 58 is composed to regulate the feeding speed of drilling device body 1*a*, namely the drilling speed, by controlling movement mechanism 160 by transmitting a signal to a movement mechanism control section 160*a* that controls movement mechanism 160. It is also composed so as to set the peripheral velocity of core bit 13 to a predetermined value of 300 m/min or more together with regulating voltage $V_M$ applied to direct motor 2 by regulating the firing angle of the trigger current.

Next, an explanation is provided of the action of drilling device 1 composed in the manner described above, and the work of drilling drilled object C using drilling device 1.

First, drilling device body 1*a* positioned towards the top side of support column section 140 is positioned at a predetermined drilling position on drilled object C so that the axis of rotating shaft 11 is aligned with that position, and installed section 130 is then fixed to drilled object C.

Once drilling device body 1*a* has been installed on drilled object C in this manner, drilling device body connector 7*a* is connected to drilling device body 1*a*, and motor power supply connector 7*b* is connected to power supply 1*b* to electrically connect drilling device body 1*a* and power supply 1*b* with cable 7. Main switch 53 of power supply 1*b* is then switched on, and the current level selector switch 54 is set to match the allowed current on the alternating current voltage supply side. Reset button 162 is then pressed, direct current voltage is applied to brush 25 of direct motor 2, power is supplied to the coil of rotor 17 (or stator 18), and together with causing rotor 17 to rotate at high speed, cooling water is fed in through tube 24 from a cooling water supply device not shown in order to perform wet drilling. In the case of manual control, the rotating speed at this time in the state of zero torque is set by turning speed adjustment knob 161 provided in remote control section 200 so that the peripheral velocity of core bit 13 reaches a predetermined value of 300 m/min or more. In the case of automatic control, the value of voltage $V_M$ applied to direct motor 2 is regulated automatically by power supply control section 58 so that the peripheral velocity of core bit 13 reaches a predetermined value of 300 m/min or more.

As a result of drilling device body 1*a* being lowered by movement mechanism 160 with core bit 13 rotating at high speed, bit 15 of core bit 13 linked to the end section of rotating shaft 11 presses against the surface of drilled object C at a pressure of 0.6 $N/mm^2$ or more. As a result, a circular hole H is formed in drilled object C by bit 15 that is rotating at high speed. At this time, in the case of automatic control, simultaneous to torque being applied to core bit 13 as a result of the end of core bit 13 beginning initial drilling into drilled object C, the value of voltage $V_M$ applied to direct motor 2 is controlled and the peripheral velocity of core bit 13 is set to a predetermined value of 300 m/min or more. The drilling tool is then fed at a predetermined pressure of 0.6 $N/mm^2$ or more while maintaining the peripheral velocity of the drilling tool at a predetermined value of 300 m/min or more by controlling the value of applied voltage $V_M$ and movement mechanism 160.

During this drilling work, in the case bit 15 contacts a hard reinforcing member such as an iron bar for reinforcing drilled object C causing the rotation of direct motor 2 to suddenly be inhibited, the induced voltage drops suddenly resulting in coil resistance only and causing an excessively large current to flow. Consequently, when a threshold value has been suitably set and the current value detected by current detector 59 exceeds this threshold value, the output from phase control section 56 is immediately interrupted by a breaker. In this manner, in the case bit 15 contacts a reinforcing member such as reinforcing iron, the rotation of direct motor 2 stops immediately and drilling work is interrupted.

In this manner, in the case drilling work has been interrupted due to the activation of an interlock, the drilling location is changed and work is resumed while avoiding contact with the iron bar. At this time, reset button 162 is pressed to resume rotation of direct motor 2.

Furthermore, during drilling work, even if cooling water should happen to contact cable 7, since the waterproofing of cable 7 is maintained, current leakage or short circuit and so forth do not occur.

Once circular hole H has been formed to a predetermined depth in this manner, an anchor hole is formed by raising drilling device body 1*a* to extract bit 15 from hole H and removing the central core. Here, in the case a core remains inside core bit 13 when bit 15 is extracted from hole H, pushing rod 36 is pushed out towards the front end.

As described above, according to the present embodiment, core bit 13 is rotated at an extremely high speed by direct motor 2 in which rotary force is imparted directly to core bit 13 from rotating shaft 11, enabling the peripheral velocity of bit 15 to reach 300 m/min.

The resistance received by bit 15 from a drilled object C during drilling can be reduced, and the work required for drilling hole H of a predetermined depth can be decreased by maintaining the peripheral velocity at the outer periphery of bit 15 at 300 m/min or more in the state in which the end of rotating core bit 13 cuts into drilled object C while pressing against drilled object C at a predetermined pressure of 0.6 $N/mm^2$ or more. In this manner, drilling speed can be increased by increasing the peripheral velocity of bit 15.

In addition, drilling speed can be increased reliably since the diameter of core bit 13 is made to be 15 mm to less than 50 mm.

In addition, since rotating shaft 11 is press fit into insertion hole 17*a* formed in the center of rotor 17 and directly fastened to be integrally formed with rotor 17, the overall rigidity of drilling device body 1*a* can be improved considerably, and as a result, holes can be formed by rotating core bit 13 at high speed, thereby making it possible to significantly increase drilling speed as compared with the case of the prior art. In this manner, drilling work can be carried out rapidly, and the time required for various types of fabrication work having drilling work can be shortened.

According to the present embodiment as described above, the value of the work required to drill a hole of a predetermined depth can be decreased by eliminating waste in that work, thereby enabling a drilled object to be drilled in a short period of time.

Furthermore, in the aforementioned embodiment, although a constitution is employed in which a drilling tool in the form of the core bit is attached directly to a rotary drive device in the form of a direct motor without going through a gear or other rotation transmission mechanism, in the case of drilling a drilled object composed of a brittle material using a core bit in which a bit formed by dispersing and arranging a cemented carbide or super abrasive in a binder phase is attached to the end, if the drilling device is that which drills by pressing the core bit against the drilled object at a pressure of 0.6 $N/mm^2$ or more while rotating at peripheral velocity at the outer periphery of the bit of 300 m/min or more, it goes without saying that a hydraulic motor or that equipped with gears may also be used for the rotary drive device. The rotary drive device referred to here includes all rotary drive means that can be conceived by a person with ordinary skill in the art.

Figure 8:
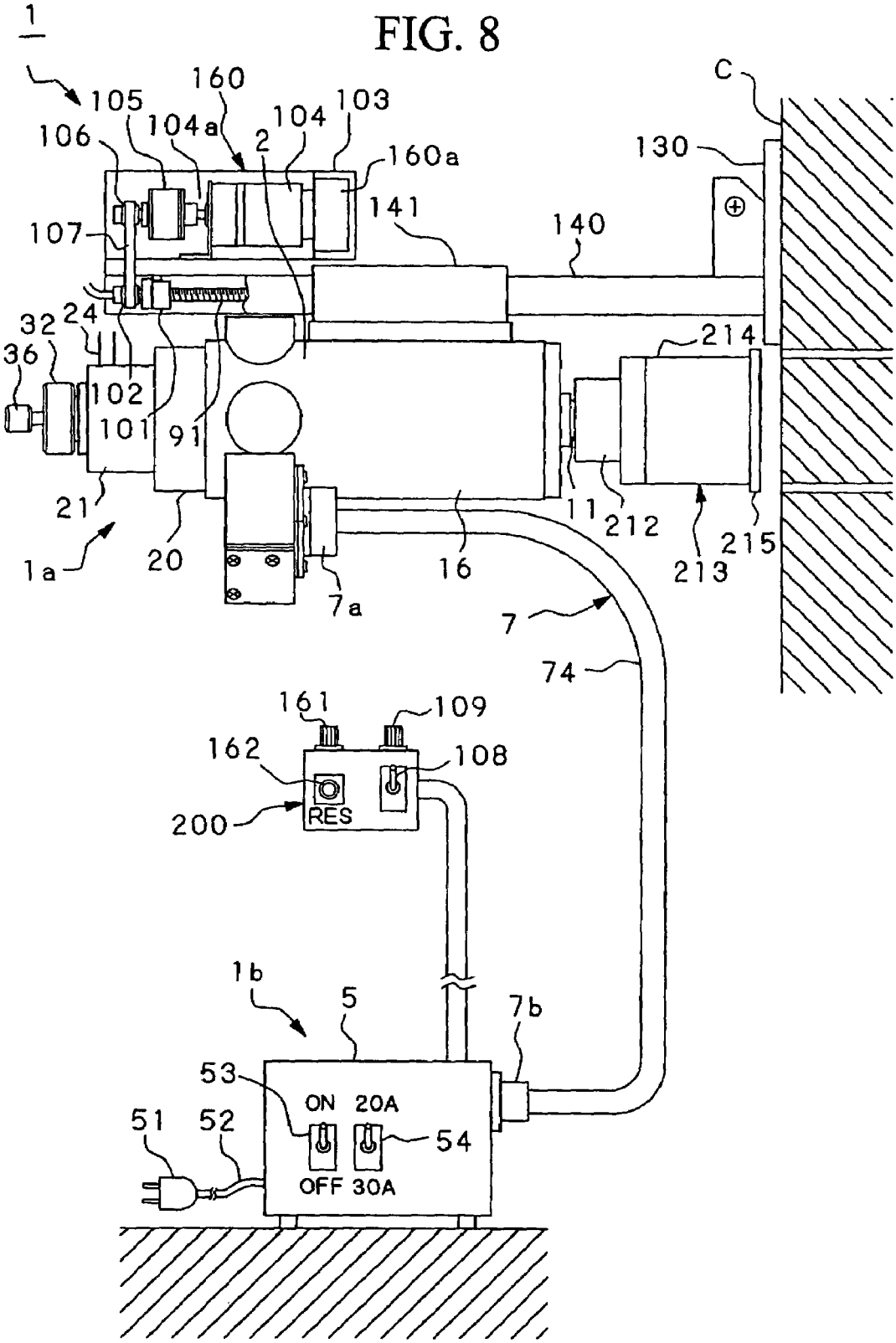
FIG. 8 is lateral view showing an example of a drilling device as a second embodiment as claimed in the present invention.
Figure 9:
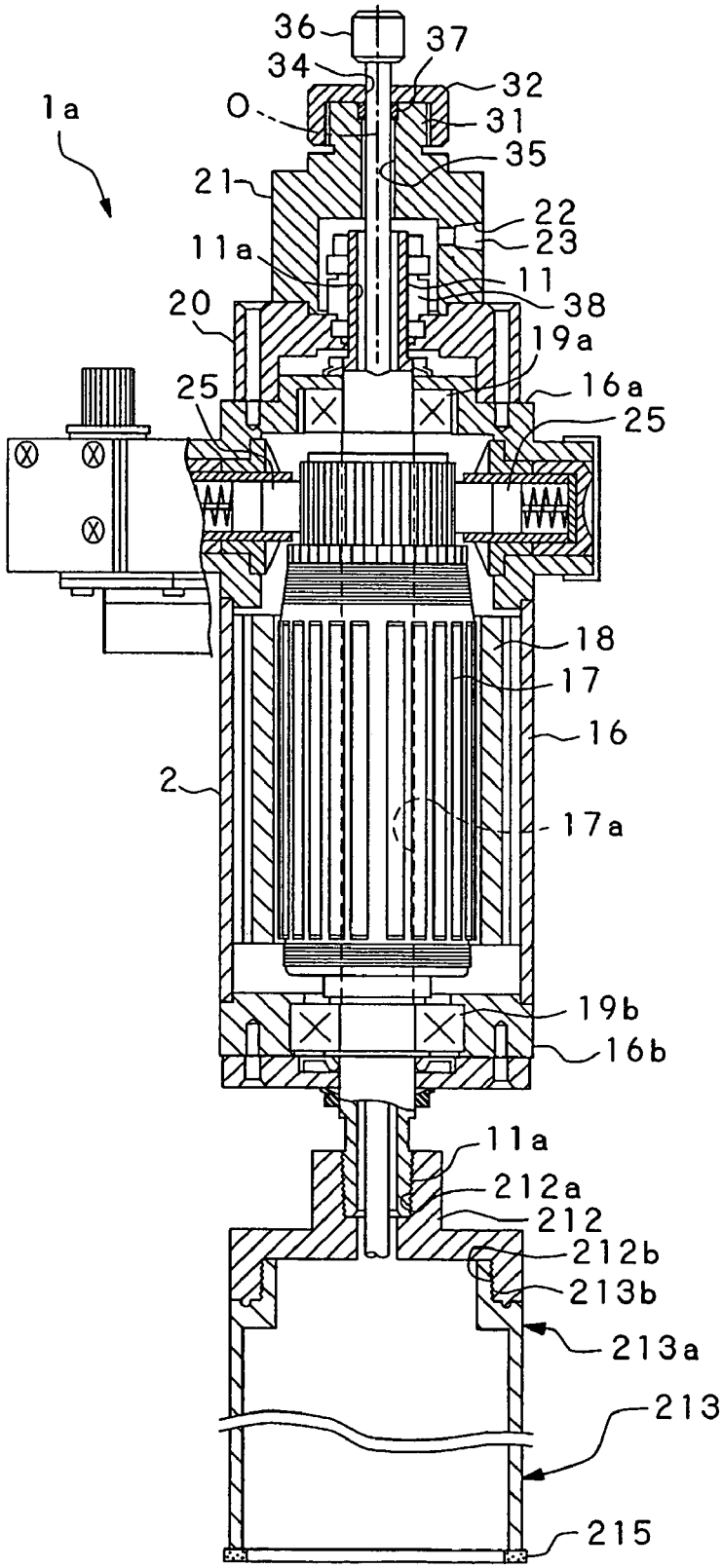
FIG. 9 is a partially cutaway lateral view showing the drilling device body of a drilling device as a second embodiment as claimed in the present invention.

Next, an explanation is provided of a second embodiment according to the present invention using FIGS. 8 and 9. In the drawings, since the sections respectively corresponding to FIGS. 1 through 5 have identical constitutions, the same reference symbols are assigned to those sections, and their explanations are omitted here. Those sections having the same reference symbols operate and function in the same manner as in the aforementioned first embodiment. In particular, although the constitutions shown in FIGS. 3 and 5 are not shown in FIGS. 8 and 9, the second embodiment described below has the same constitution as the constitutions shown in FIGS. 3 and 5.

In the present embodiment, core bit 213 is composed with bit 215 attached in a roughly ring shape in the circumferential direction on the end of a hollow tube 214 (tool body) formed in the shape of a cylinder having a diameter of 50-200 mm. Here, bit 215 is formed by dispersing and arranging a cemented carbide or super abrasive (diamond abrasive or CNB abrasive) in a binder phase composed by sintering and hardening a metal bond, resin bond or other binder material. Alternatively, in the case the drilled object is marble, bit 215 is formed by dispersing and arranging a super abrasive in binder phase by electrodeposition. Core bit 213 to which this bit 215 is attached to its end is composed so as to drill drilled object C and form a cylindrical core by being rotated around an axis and being fed towards the front end in the axial direction.

Removable section 213*a* attached to adapter 212 is provided on the base end side of this core bit 213. Male threaded section 213*b* that screws into female threaded section 212*b* of adapter 212 is formed on this removable section 213*a* along the axial direction of core bit 213. Furthermore, male threaded section 213*b* is formed in the orientation in which core bit 213 is fastened to adapter 212 due to rotation of core bit 213 during drilling.

Adapter 212 has a roughly hollow cylindrical shape, and a female threaded section 212*a*, which screws onto threaded section 11*a* of the end of rotating shaft 11 is provided on its base end side, while a female threaded section 212*b*, to which is attached the base end of core bit 213, is provided along the direction of axis O of rotating shaft 11 on its front end. Furthermore, female threaded section 212*a* is formed in the orientation in which it is fastened to rotating shaft 11 due to rotation during drilling.

Direct motor 2 has a cylindrical rotating shaft 11 in its center, and on the end of this rotating shaft 11, adapter 212 is removably screwed onto a threaded section 11*a* formed on the end of rotating shaft 11, and a cylindrical core bit 213 (drilling tool) is removably attached to this adapter 212 so as to form a through hole continuous with rotating shaft 11. This direct motor 2 is a direct type of motor that directly rotates core bit 13, which is a tool directly coupled to rotating shaft 11, without using gears or other rotation transmission mechanism, and is composed so as to allow core bit 13 having a diameter of 50 mm to less than 200 mm to rotate at a peripheral velocity of 300-2000 m/min while being pressed against drilled object C at a pressure within the range of 0.6-6 $N/mm^2$.

As described above, according to the present embodiment, core bit 213 is rotated at an extremely high speed by direct motor 2 in which rotary force is imparted directly to core bit 213 from rotating shaft 11, enabling the peripheral velocity of bit 215 to reach 300 m/min.

The resistance received by bit 15 from a drilled object C during drilling can be reduced, and the work required for drilling hole H of a predetermined depth can be decreased by maintaining the peripheral velocity at the outer periphery of bit 215 at 300 m/min or more in the state in which the end of rotating core bit 213 cuts into drilled object C while pressing against drilled object C at a predetermined pressure of 0.6 N/mm$^2$ or more. In this manner, drilling speed can be increased by increasing the peripheral velocity of bit 215.

In addition, drilling speed can be increased reliably since the diameter of core bit 213 is made to be 50 mm to less than 200 mm.

In addition, since rotating shaft 11 is press fit into insertion hole 17*a* formed in the center of rotor 17 and directly fastened to be integrally formed with rotor 17, the overall rigidity of drilling device body 1*a* can be improved considerably, and as a result, holes can be formed by rotating core bit 213 at high speed, thereby making it possible to significantly increase drilling speed as compared with the case of the prior art. In this manner, drilling work can be carried out rapidly, and the time required for various types of fabrication work having drilling work can be shortened.

Furthermore, in the aforementioned second embodiment, although a constitution is employed in which a drilling tool in the form of the core bit is attached directly to a rotary drive device in the form of a direct motor without going through a gear or other rotation transmission mechanism, in the case of drilling a drilled object composed of a brittle material using a core bit in which a bit formed by dispersing and arranging a cemented carbide or super abrasive in a binder phase is attached to the end, if the drilling device is that which drills by pressing the core bit against the drilled object at a pressure of 0.6 N/mm$^2$ or more while rotating at a peripheral velocity at the outer periphery of the bit of 300 m/min or more, it goes without saying that a hydraulic motor or that equipped with gears may also be used for the rotary drive device. The rotary drive device referred to here includes all rotary drive means that can be conceived by a person with ordinary skill in the art.

Figure 10:
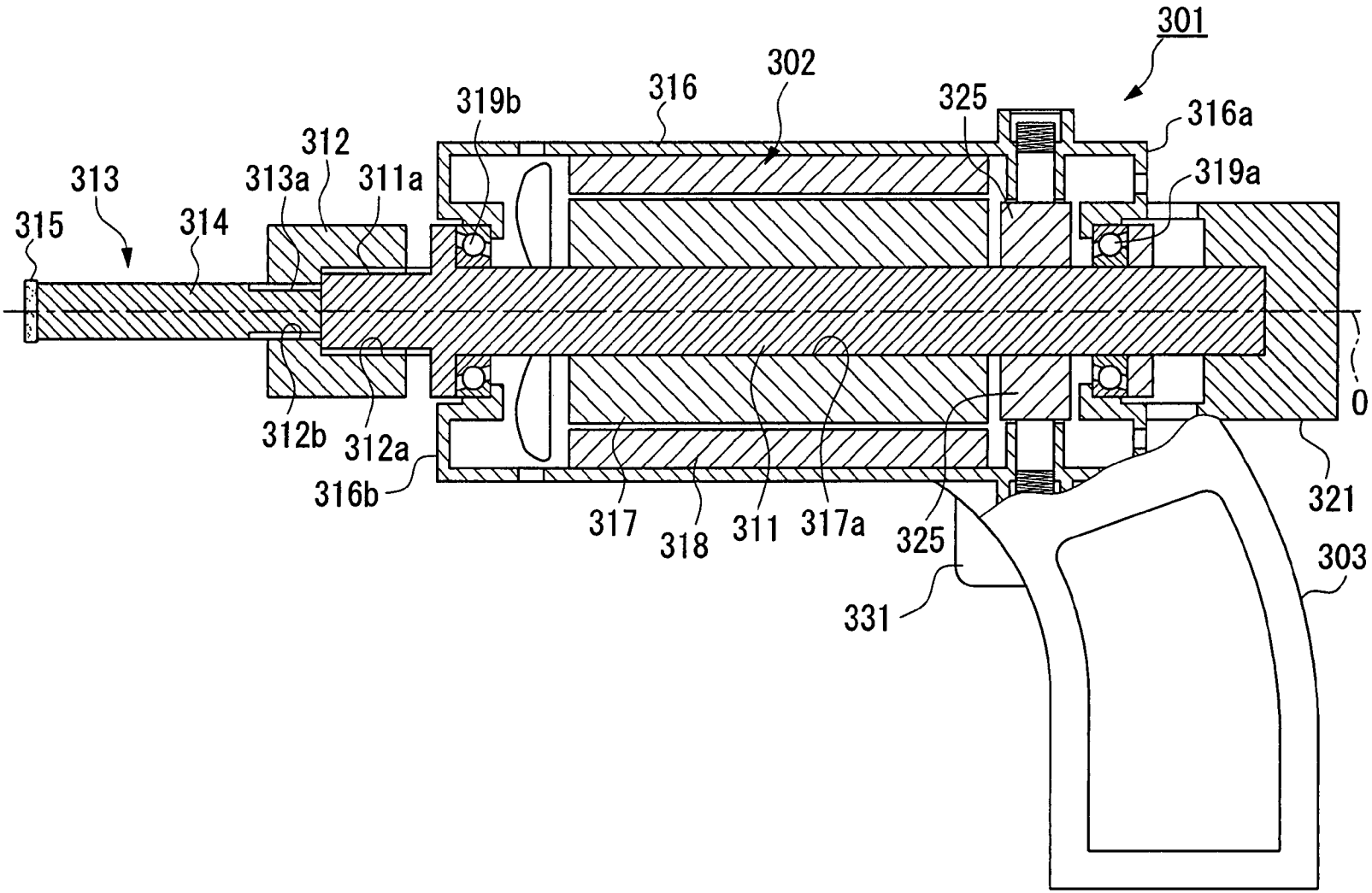
FIG. 10 is a partially cutaway lateral view showing the drilling device body of a drilling device as a third embodiment as claimed in the present invention.
Figure 11:
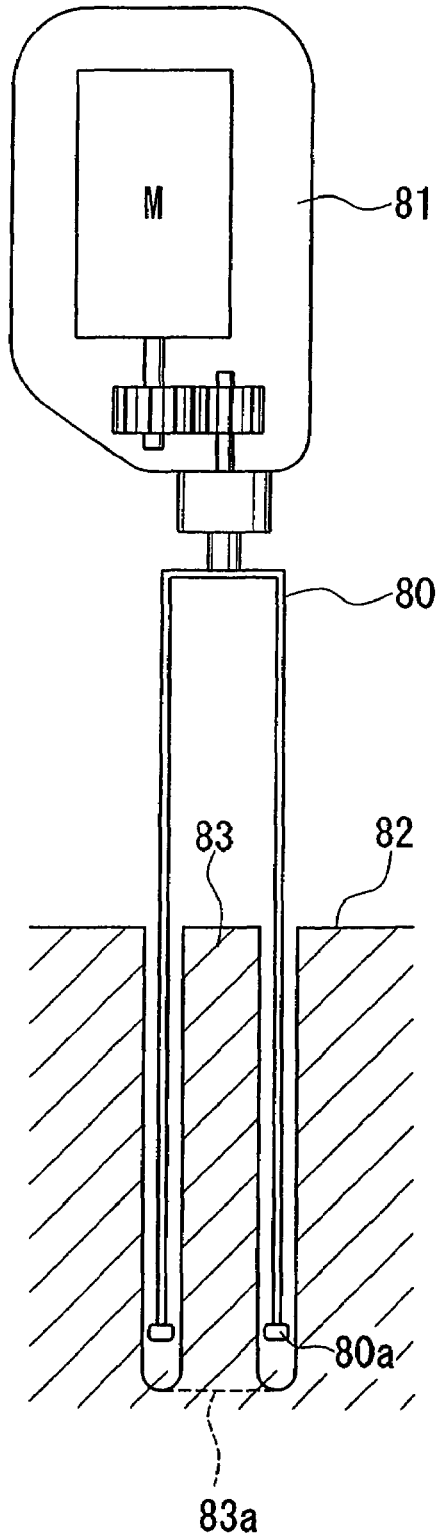
FIG. 11 (PRIOR ART)
FIG. 11 is a cross-sectional view of a drilling device for explaining the structure of a drilling device of the prior art.

Next, an explanation is provided of a third embodiment according to the present invention using FIG. 10.

In FIG. 10, reference symbol 301 indicates a drilling device, and reference symbol 302 indicates a direct current motor in the form of a direct motor (rotary drive device) that composes this drilling device 301.

Direct motor 302 is in the form of a direct current motor that rotates when a direct current voltage is applied, and as shown in the drawing, has a cylindrical rotating shaft 311 in its center, and on the end of this rotating shaft 311, an adapter 312 is removably screwed onto a threaded section 311*a* formed on the end of rotating shaft 311, and a rod-shaped drilling tool 313 is removably screwed onto to this adapter 312.

Here, adapter 312 has a roughly hollow cylindrical shape, and a female threaded section 312*a*, which screws onto threaded section 311*a* of the end of rotating shaft 311 is provided on its base end side, while a female threaded section 312*b*, to which is attached the base end of drilling tool 313, is provided along the direction of axis O of rotating shaft 311 on its front end. Here, female threaded section 312*a* is formed in the orientation in which it is fastened to rotating shaft 311 due to rotation during drilling.

In addition, drilling tool 313 is made to have a structure in which bit 315 is attached to the end of a rod-shaped drill body 314 having a diameter of 3-15 mm. Here, bit 315 is formed by dispersing and arranging a cemented carbide or super abrasive (diamond abrasive or CNB abrasive) in a binder phase composed by sintering and hardening a metal bond, resin bond or other binder material. Alternatively, bit 315 is formed by dispersing and arranging a super abrasive in binder phase by electrodeposition. Drilling tool 313, to which this bit 315 is attached to its end, is composed so as to drill drilled object C comprised of a brittle material such as tiles or joints of tiled walls by being rotated around an axis and being fed towards the front end in the axial direction.

Male threaded section 313*a*, which screws into female threaded section 312*b* of adapter 312, is formed on the base end of this drilling tool 313 along the axial direction of drilling tool 313. Here, male threaded section 313*a* is formed in the orientation in which drilling tool 313 is fastened to adapter 312 due to rotation of drilling tool 313 during drilling.

Direct motor 302 is a direct type of motor that directly rotates drilling tool 313, which is a tool directly coupled to rotating shaft 311, without using gears or other rotation transmission mechanism, and is composed so as to allow drilling tool 313 having a diameter of 3 mm to less than 15 mm to rotate at a peripheral velocity of 300-2000 m/min while being pressed against a drilled object at a pressure within the range of 0.6-6 N/mm$^2$.

In addition, direct motor 302 is composed of a rotor 317, composed by winding a coil coated with polyimide or other heat-resistant resin, and a cylindrical stator 318 provided around the outer peripheral surface of this rotor 317 and having a permanent magnet, within a housing 316. Rotating shaft 311 is inserted through insertion hole 317*a* formed in the center of the aforementioned rotor 317 so as to be press fit inside, and integrally fixed to rotor 317.

Here, a niobium-iron-boron-based or samarium-cobalt-based rare earth, high-density magnet is used for the magnet of stator 318 for the purpose of realizing small size, light weight and a high torque since the maximum magnetic energy product of 100 kJm$^{-3}$ or more is much higher than that of typically used ferrite magnets or alnico magnets. In addition, the diameter of rotor 317 is to be smaller than its length. As a result, the torque constant of direct rotor 302 in the present embodiment is 0.12 Nm/A, and the relationship of $T=0.12*I_M-0.6$ is valid between generated torque T (units: Nm) and current $I_M$ (units: A) flowing to direct motor 302 in the present embodiment.

Bearings 319*a* and 319*b* are respectively installed on the insides of upper wall section 316*a* and lower wall section 316*b* of housing 316 that houses direct motor 302 in order to rotatably support rotor 312. Namely, bearings 319*a* and 319*b* are made to support the vicinities of the upper and lower ends of rotating shaft 311 inserted through the center of rotor 317, and are composed so as to be able to receive force in the thrust direction and force in the radial direction that act on rotor rotating shaft 311 and rotor 317 inserted through this rotating shaft 311.

In addition, an upper housing 321, which houses the rear end section of rotating shaft 311, is provided on the rear end section of this direct motor 302.

Furthermore, reference symbol 325 indicates a brush section arranged in the peripheral direction of rotating shaft 311 so as to contact rotating shaft 311 in the upper portion of housing 316 of direct motor 302, and a direct current voltage is applied to this brush section 325 to supply drive current.

The power supply that supplies direct current to direct motor 302 is incorporated within a grip section 303 for holding drilling device 301 in the hand, and is roughly composed of a battery (not shown), a wiring section (not shown) that electrically connects this battery to brush section 325, and a switch section (not shown) that switches a circuit on and off in collaboration with a trigger 331 provided on the front end side of the grip section so as to be able to be pulled with the finger.

Next, an explanation is provided of the action of drilling device 301 having the aforementioned constitution, and drilling work for drilling a drilled object composed of a brittle material such as tiles or tile joints using drilling device 301.

First, drilling device 301 is held with grip section 303, and positioned at a predetermined drilling position on the drilled object so that the axis of rotating shaft 311 is aligned. Once drilling device 301 has been positioned relative to the drilled object in this manner, trigger 331 is pulled with the finger, direct current voltage is applied to brush 325 of direct motor 302, current flows to the coil of rotor 317 (or stator 318), and rotor 317 rotates at high speed. Here, the rotating speed at this time in the no-load state in the case of manual control is set by turning a speed adjustment knob not shown so that the peripheral velocity of drilling tool 313 reaches a predetermined value of 300 m/min or more. In the case of automatic control, the value of voltage $V_M$ applied to direct motor 302 is adjusted automatically so that the peripheral velocity of drilling tool 313 reaches a predetermined value of 300 m/min or more.

Bit 315 of drilling tool 313 linked to the front end section of rotating shaft 311 presses against the surface of the drilled object in the state in which drilling tool 313 is rotated at high speed. As a result, a hole H is formed in the drilled object by bit 315 that is rotating at high speed. At this time, in the case of automatic control, simultaneous to torque being applied to drilling tool 313 as a result of the end of drilling tool 313 beginning initial drilling into the drilled object, the value of voltage $V_M$ applied to direct motor 302 is controlled and the peripheral velocity of drilling tool 313 is set to a predetermined value of 300 m/min or more. The drilling tool is then fed at a predetermined pressure of 0.6 N/mm$^2$ or more while maintaining the peripheral velocity of the drilling tool at a predetermined value of 300 m/min or more by controlling the value of applied voltage $V_M$. Here, the peripheral velocity of drilling tool 313 is increased the faster the feeding speed of drilling tool 313 so that the load does not increase as the lead angle becomes larger during drilling.

As has been described above, according to the present embodiment, drilling tool 313 is rotated at an extremely high speed by direct motor 302 in which rotary force is imparted directly to drilling tool 313 from rotating shaft 311, enabling the peripheral velocity of bit 315 to reach 300 m/min.

The resistance received by bit 315 from a drilled object during drilling can be reduced, and the work required for drilling a hole of a predetermined depth can be decreased by maintaining the peripheral velocity at the outer periphery of bit 315 at 300 m/min or more in the state in which the end of rotating drilling tool 313 cuts into the drilled object while pressing against the drilled object at a predetermined pressure of 0.6 N/mm$^2$ or more. In this manner, drilling speed can be increased by increasing the peripheral velocity of bit 315.

In addition, drilling speed can be increased reliably since the diameter of drilling tool 313 is made to be 3 mm to less than 15 mm.

In addition, since rotating shaft 311 is press fit into insertion hole 317*a* formed in the center of rotor 317 and directly fastened to be integrally formed with rotor 317, the overall rigidity of drilling device 301 can be improved considerably, and as a result, holes can be formed by rotating drilling tool 313 at high speed, thereby making it possible to significantly increase drilling speed as compared with the case of the prior art. In this manner, drilling work can be carried out rapidly, and the time required for various types of fabrication work having drilling work can be shortened.

Furthermore, in the aforementioned embodiment, although a constitution is employed in which a drilling tool is attached directly to a rotary drive device in the form of a direct motor without going through a gear or other rotation transmission mechanism, in the case of drilling a drilled object composed of a brittle material using a core bit in which a bit formed by dispersing and arranging a cemented carbide or super abrasive in a binder phase is attached to the end, if the drilling device is that which drills by pressing the drilling tool against the drilled object at a pressure of 0.6 N/mm$^2$ or more while rotating at peripheral velocity at the outer periphery of the bit of 300 m/min or more, it goes without saying that a hydraulic motor or that equipped with gears may also be used for the rotary drive device. The rotary drive device referred to here includes all rotary drive means that can be conceived by a person with ordinary skill in the art.

EXPERIMENTAL EXAMPLES

The following provides an explanation of experimental examples of a drilling method using drilling device 1 in the aforementioned first embodiment.

Experimental Example 1

The following provides a detailed description based on data from a demonstration experiment of the effect that, in the drilling device 1 provided with the previously described constitution, if the peripheral velocity of bit 15 is made to be 300 m/min or more, the amount of drilling work required to actually drill a hole of a predetermined depth decreases, and drilling speed can be increased with the increase in peripheral velocity.

In order to measure drilling speed with respect to drilled object C, the peripheral velocity of bit 15 was changed by changing the rotating speed of core bit 13 per minute while maintaining the generated torque roughly constant, and the drilling time required to drill a predetermined depth of 100 mm to 220 mm was measured with respect to drilled object C, composed of concrete having compressive strength according to JIS standards of 210 kgf/cm$^2$, for each peripheral velocity. Here, a core bit to which bit 15 was attached over roughly the entire circumference to the end of a tube 14 was used for core bit 13, while a bit having an outer diameter of 25 mm, cutting edge thickness of 2 mm and length in the axial direction of 6 mm, and formed by dispersing and arranging high-grade diamond abrasive having a mesh size of #40/50 in a metal bonding material in the form of W—Cu—Sn at a density of 1.76 ct/cc, was used for bit 15. In addition, drilling was carried out downward while allowing cooling water at roughly room temperature to flow at the rate of 3 l/min.

Tables 1 through 5 indicate the results of feeding core bit 13 towards drilled object C while applying a predetermined pressure, allowing a torque load as close as possible to that during drilling to act on core bit 13 while maintaining the current flowing to direct motor 2 at a roughly constant value, and measuring the rotating speed at that time and drilling time in the case of the rotating speed of core bit 13 in the no-load state being 1000 rpm, 1500 rpm, 2000 rpm, 3000 rpm or 5000 rpm, respectively. In order to confirm that the condition of core bit 13 did not change during these measurements, confirmation drilling was carried out at a rotating speed of about 7000 rpm before and after each measurement.

TABLE 1

| | | No-Load | | | During Drilling | | | | |
|---|---|---|---|---|---|---|---|---|---|
| Speed | No. of Holes | Speed (RPM) | Peri. Velo. (m/min) | Current (A) | Speed (RPM) | Peri. Velo. (m/min) | Current (A) | Hole depth (mm) | Drill Time (sec.) |
| 1000 RPM | | 1000 | 78.5 | 7 | — | — | — | — | — |
| Confirm. Drilling | | — | — | — | 7200 | 565.2 | 32 | 220 | 19 |
| | 1 | — | — | — | 700 | 55.0 | 32 | 100 | 41 |
| | 2 | — | — | — | 600 | 47.1 | 28 | 100 | 56 |
| | 3 | — | — | — | 800 | 62.8 | 26 | 100 | 53 |
| | 4 | — | — | — | 900 | 70.7 | 26 | 100 | 67 |
| | 5 | — | — | — | 800 | 62.8 | 26 | 100 | 71 |
| | 6 | — | — | — | 800 | 62.8 | 24 | 100 | 82 |
| | 7 | — | — | — | 800 | 62.8 | 24 | 100 | 65 |
| | 8 | — | — | — | 800 | 62.8 | 24 | 100 | 75 |
| | 9 | — | — | — | 800 | 62.8 | 24 | 100 | 84 |
| | 10 | — | — | — | 800 | 62.8 | 25 | 100 | 94 |
| | Avg. | — | — | — | 780 | 61.2 | 25 | 100 | 69 |
| Confirm. Drilling | | — | | — | 7000 | 549.5 | 28 | 220 | 21 |

TABLE 2

| | | No-Load | | | During Drilling | | | | |
|---|---|---|---|---|---|---|---|---|---|
| Speed | No. of Holes | Speed (RPM) | Peri. Velo. (m/min) | Current (A) | Speed (RPM) | Peri. Velo. (m/min) | Current (A) | Hole depth (mm) | Drill Time (sec.) |
| 1500 RPM | | 1500 | 117.8 | 9 | — | — | — | — | — |
| Confirm. Drilling | | — | — | — | 7100 | 557.4 | 28 | 220 | 16 |
| | 1 | — | — | — | 1100 | 86.4 | 28 | 100 | 41 |
| | 2 | — | — | — | 1200 | 94.2 | 32 | 100 | 43 |
| | 3 | — | — | — | 1200 | 94.2 | 28 | 100 | 46 |
| | 4 | — | — | — | 1300 | 102.1 | 30 | 100 | 49 |
| | 5 | — | — | — | 1200 | 94.2 | 28 | 100 | 65 |
| | 6 | — | — | — | 1200 | 94.2 | 28 | 100 | 64 |
| | 7 | — | — | — | 1300 | 102.1 | 28 | 100 | 77 |
| | 8 | — | — | — | 1200 | 94.2 | 26 | 100 | 68 |
| | 9 | — | — | — | 1200 | 94.2 | 28 | 100 | 63 |
| | 10 | — | — | — | 1100 | 86.4 | 28 | 100 | 72 |
| | Avg. | — | — | — | 1200 | 94.2 | 28 | 100 | 59 |
| Confirm. Drilling | | — | | — | 7200 | 565.2 | 28 | 220 | 25 |

TABLE 3

| | | No-Load | | | During Drilling | | | | |
|---|---|---|---|---|---|---|---|---|---|
| Speed | No. of Holes | Speed (RPM) | Peri. Velo. (m/min) | Current (A) | Speed (RPM) | Peri. Velo. (m/min) | Current (A) | Hole depth (mm) | Drill Time (sec.) |
| 2000 RPM | | 2000 | 157.0 | 9 | — | — | — | — | — |
| Confirm. Drilling | | — | — | — | 7100 | 557.4 | 30 | 220 | 18 |
| | 1 | — | — | — | 1500 | 117.8 | 32 | 100 | 41 |
| | 2 | — | — | — | 1600 | 125.6 | 28 | 100 | 56 |
| | 3 | — | — | — | 1700 | 133.5 | 26 | 100 | 53 |
| | 4 | — | — | — | 1700 | 133.5 | 26 | 100 | 67 |
| | 5 | — | — | — | 1700 | 133.5 | 26 | 100 | 71 |
| | 6 | — | — | — | 1800 | 141.3 | 24 | 100 | 82 |
| | 7 | — | — | — | 1700 | 133.5 | 24 | 100 | 65 |
| | 8 | — | — | — | 1800 | 141.3 | 24 | 100 | 75 |
| | 9 | — | — | — | 1800 | 141.3 | 24 | 100 | 84 |
| | 10 | — | — | — | 1800 | 141.3 | 20 | 100 | 94 |
| | Avg. | — | — | — | 1710 | 134.2 | 25 | 100 | 69 |
| Confirm. Drilling | | — | | — | 7000 | 549.5 | 32 | 220 | 27 |

TABLE 4

| Speed | No. of Holes | No-Load Speed (RPM) | No-Load Peri. Velo. (m/min) | No-Load Current (A) | During Drilling Speed (RPM) | During Drilling Peri. Velo. (m/min) | During Drilling Current (A) | Hole depth (mm) | Drill Time (sec.) |
|---|---|---|---|---|---|---|---|---|---|
| 3000 RPM | | 3000 | 235.5 | 9 | — | — | — | — | — |
| Confirm. Drilling | | 7700 | 604.5 | 11 | 6900 | 541.7 | 30 | 220 | 22 |
| | 1 | — | — | — | 2600 | 204.1 | 28 | 100 | 41 |
| | 2 | — | — | — | 2500 | 196.3 | 32 | 100 | 43 |
| | 3 | — | — | — | 2500 | 196.3 | 28 | 100 | 46 |
| | 4 | — | — | — | 2800 | 219.8 | 30 | 100 | 49 |
| | 5 | — | — | — | 2600 | 204.1 | 28 | 100 | 65 |
| | 6 | — | — | — | 2800 | 219.8 | 28 | 100 | 64 |
| | 7 | — | — | — | 2800 | 219.8 | 28 | 100 | 77 |
| | 8 | — | — | — | 2800 | 219.8 | 26 | 100 | 68 |
| | 9 | — | — | — | 2700 | 212.0 | 28 | 100 | 63 |
| | 10 | — | — | — | 2700 | 212.0 | 28 | 100 | 72 |
| | Avg. | — | — | — | 2680 | 210.4 | 28 | 100 | 59 |
| Confirm. Drilling | | — | | — | 7000 | 549.5 | 28 | 220 | 33 |

TABLE 5

| Speed | No. of Holes | No-Load Speed (RPM) | No-Load Peri. Velo. (m/min) | No-Load Current (A) | During Drilling Speed (RPM) | During Drilling Peri. Velo. (m/min) | During Drilling Current (A) | Hole depth (mm) | Drill Time (sec.) |
|---|---|---|---|---|---|---|---|---|---|
| 5000 RPM | | 5000 | 392.5 | 8 | — | — | — | — | — |
| Confirm. Drilling | | — | — | — | 7200 | 565.2 | 30 | 220 | 20 |
| | 1 | — | — | — | 4100 | 321.9 | 32 | 100 | 18 |
| | 2 | — | — | — | 4500 | 353.3 | 32 | 100 | 17 |
| | 3 | — | — | — | 4500 | 353.3 | 30 | 100 | 17 |

In these tables, the current value applied to direct motor 2 during drilling was kept constant at about 28 A. Since the relationship of $T=0.12*I_M-0.6$ is valid between generated torque T (units: Nm) and current $I_M$ (units: A) in the present embodiment, generated torque can also be seen to be kept constant along with the load subjected to bit 15 from drilled object C. In other words, this means that the force applied in the tangential direction of bit 15 was roughly constant, because the outer diameter of bit 15 is constant at 25 mm. When the cutting depth by bit 15 into drilled object C is changed, the resistance received from drilled object C also changes correspondingly. Therefore, the fact that the force applied in the tangential direction of bit 15 was roughly constant means that, either the cutting depth into drilled object C by bit 15 was also roughly of the same degree, or even if this was not the case, if the load increased as the friction between core bit 13 and/or bit 15 and the cuttings and/or drilled object C increased the higher the rotating speed, the cutting depth into drilled object C by bit 15 would at least not be as large in the case of a high rotating speed as compared with the case of a low rotating speed.

In addition, Table 6 shows the results of using two different values for the value of the torque load applied to core bit 13 during drilling, and measuring rotating speed and drilling time at the respective times by maintaining the current value flowing to direct motor 2 during drilling roughly at the two different values of 15 A and 30 A, respectively, and feeding core bit 13 while applying a predetermined pressure towards drilled object C with respect to the case of the rotating speed of core bit 13 during the no-load state being 1000 rpm, 1500 rpm, 2000 rpm, 3000 rpm, 4000 rpm or 5000 rpm, respectively, in order to compare different load conditions.

TABLE 6

| Core bit rotating speed $f_N$ (rpm) No-load | Core bit rotating speed $f_N$ (rpm) Loaded | Bit peri. velo. (m/min) Loaded | Hole depth (mm) | Drilling time Δt (sec) | Drilling speed (mm/sec) |
|---|---|---|---|---|---|
| | | Current (30 A) Torque (3.0 Nm) | | | |
| 1000 | 780 | 61.2 | 100 | 69 | 1.4 |
| 1500 | 1200 | 94.2 | 100 | 59 | 1.7 |
| 2000 | 1710 | 134.2 | 100 | 69 | 1.4 |
| 3000 | 2680 | 210.4 | 100 | 59 | 1.7 |
| 4000 | 3600 | 282.6 | 100 | 16 | 6.3 |
| 5000 | 4370 | 343.0 | 100 | 17 | 5.9 |
| 7000 | 6900 | 541.7 | 100 | 9 | 11.1 |
| | | Current (15 A) Torque (1.2 Nm) | | | |
| 1000 | 900 | 70.7 | 100 | 260 | 0.38 |
| 1500 | 1400 | 110.0 | 100 | 158 | 0.63 |
| 2000 | 1900 | 149.2 | 100 | 163 | 0.61 |
| 3000 | 2800 | 219.8 | 100 | 107 | 0.93 |
| 4000 | 3800 | 298.3 | 100 | 51 | 1.96 |
| 5000 | 4700 | 369.0 | 100 | 36 | 2.78 |

As was previously described, since the output power $P_{output}$ as the power at which the drilling device performs drilling can be represented as $P_{output} \propto Tf_N$ proportional to the product of rotating speed $f_N$ and generated torque T, if the peripheral velocity of bit 15 is increased by increasing rotating speed $f_N$ while maintaining the generated torque T roughly constant, output power $P_{output}$ increases correspondingly. Since drilling in the aforementioned experiment is carried out while holding force in the tangential direction applied to bit 15 roughly constant, while maintaining the current value constant, and applying a roughly constant force $F_N$ in the axial direction, the amount of drilling work E for drilling a hole of a predetermined depth L becomes $E=2\pi Tf_N*\Delta t+F_N L$ when drilling time is represented with $\Delta t$. First, in the ideal case where there is no work loss caused by friction, the amount of drilling work E required to drill to a fixed depth is considered to be constant regardless of rotating speed $f_N$. This being the case, the drilling time $\Delta t$ required for drilling decreases accompanying an increase in output power $P_{output}$, and drilling speed $V_H=L/\Delta t$ is considered to increase proportional to output power $P_{output}$.

Figure 6:
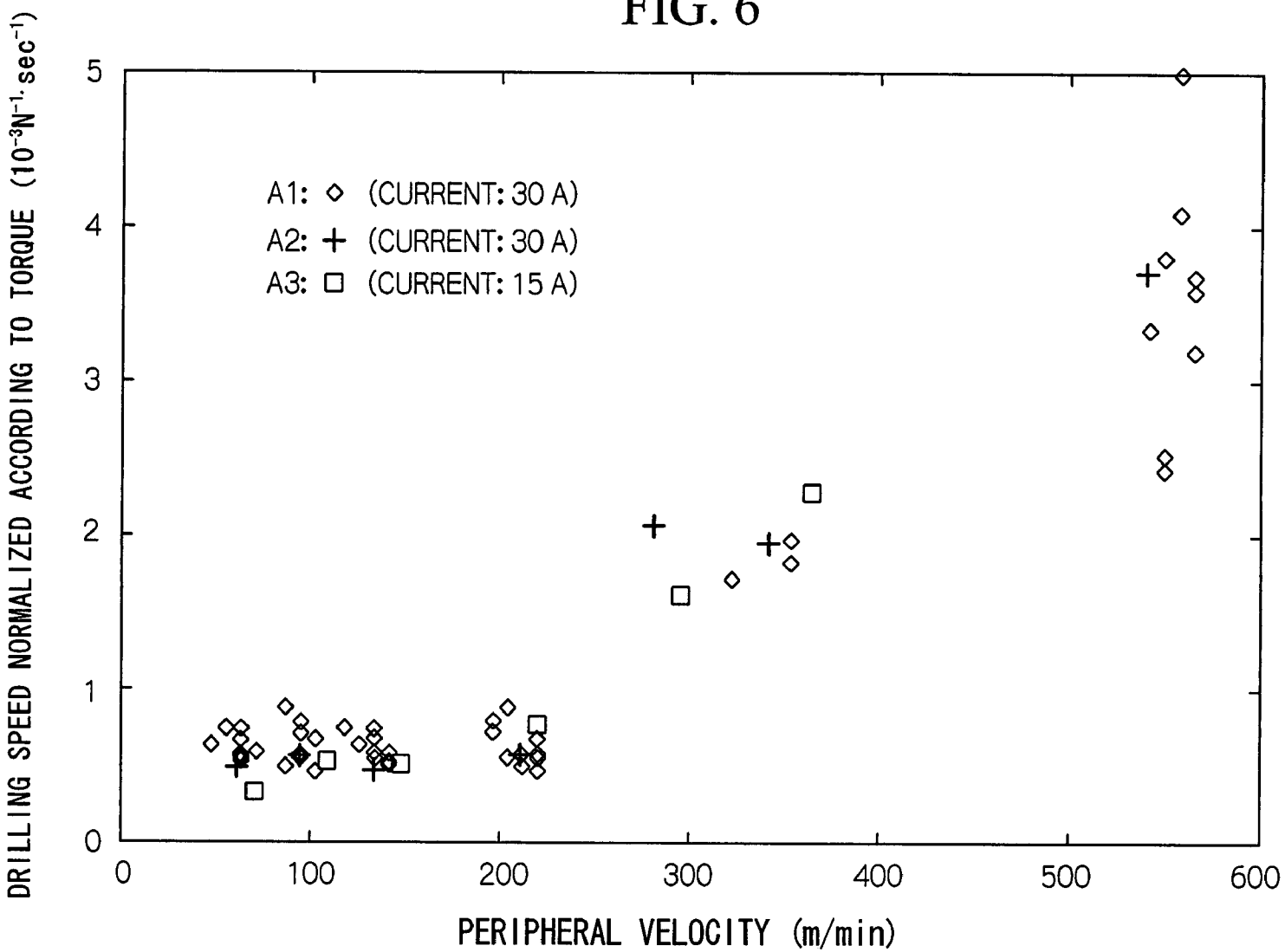
FIG. 6 is a graph showing the relationship between bit peripheral velocity and drilling speed standardized according to torque value.

FIG. 6 shows a graph of peripheral velocity at the outer periphery of bit 15 versus drilling speed as determined from the values of Tables 1 through 6, with peripheral velocity (m/min) plotted on the horizontal axis and drilling speed plotted on the vertical axis.

Here, in order to compare drilling speed after removing the effect of generated torque, which, although is roughly constant in Tables 1 through 6, fluctuates slightly (by about 20%), on drilling speed, the normalized quantity $(L/\Delta t)/T$ (units: $10^{-3}$ $N^{-1}$ $sec^{-1}$), obtained by dividing drilling speed by the value of generated torque during drilling, is used as the drilling speed in FIG. 6. Thus, FIG. 6 indicates the manner of the change in drilling speed in the case in which only the peripheral velocity of bit 15 changes while the value of generator torque remains constant. In this graph, the diamond points A1 and the + points A2 indicate that when the current flowing to direct motor 2 is about 30 A, while the square points A3 indicate that when the current flowing to direct motor 2 is about 15 A.

As can be understood from the graph, when the peripheral velocity is 220 m/min or less, contrary to what is expected, drilling speed does not increase proportionately when the peripheral velocity of core bit 13 is increased. On the contrary, the values can be seen to remain constant. Moreover, this trend does not change even if the current flowing to direct motor 2, namely the generated torque, differs. As was previously mentioned, since the cutting depth by the bit and generated torque are interrelated, and the generated torque in the present experimental example is constant, the results suggest that the increase in drilling speed at a peripheral velocity of 300 m/min or more is not due to a change in peripheral velocity along with a change in cutting depth.

Figure 7:
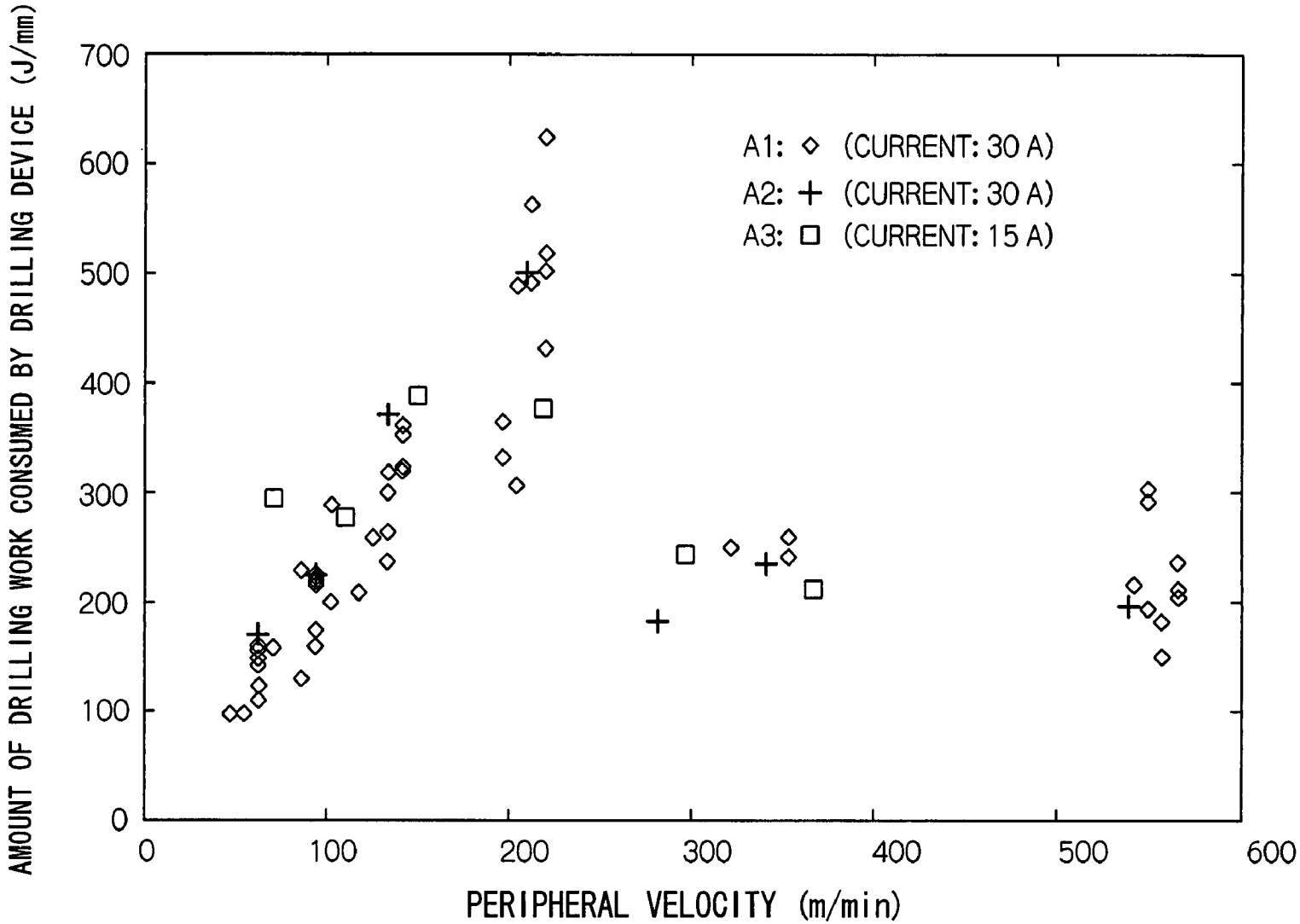
FIG. 7 is a graph showing the relationship between bit peripheral velocity and the amount of drilling work by a drilling device.

FIG. 7 is a graph of the peripheral velocity at the outer periphery of bit 15 (units: m/min) plotted on the horizontal axis versus the amount of drilling work (units: J/mm) by the drilling device per unit depth plotted on the vertical axis by determining the amount of drilling work E by the drilling device using the relationship of $E_0=2\pi Tf_N*\Delta t$ focusing only on the amount of drilling work $E_0$ performed by the drilling device from the values of Tables 1 through 6 while ignoring the work required for feeding the drilling device by assuming it to be constant. In this graph, the diamond points A1 and + points A2 indicate that when the current flowing to direct motor 2 is about 30 A, while the square points A3 indicate that when the current flowing to direct motor 2 is about 15 A. It can be determined from the graph that the amount of drilling work $E_0$ by the drilling device increases roughly proportional to peripheral velocity up to a peripheral velocity of 220 m/min. Moreover, the value of the amount of drilling work $E_0$ at each peripheral velocity is the same even though the current flowing to direct motor 2 differs. This is thought to be because, since the load increases in proportion to cutting depth while the total rotating speed of core bit 13 required for drilling decreases when the cutting depth by bit 15 is large, the amount of drilling work $E_0$ does not change overall. In any case, even in cases in which the pressure when core bit 13 is pressed against drilled object C differs and the value of the load applied to core bit 13 varies, at peripheral velocities of 220 m/min or less, drilling speed does not increase since the amount of drilling work increases accompanying increases in peripheral velocity of core bit 13.

However, in looking at the regions of FIG. 7 where the peripheral velocity of the bit is high, the amount of drilling work $E_0$ by the drilling device over a peripheral velocity range of 250 m/min to 300 m/min decreases rapidly with increases in peripheral velocity, and at least in the region of a peripheral velocity of 300 m/min or more, can be seen to decrease to less than half the value of the amount of drilling work at a peripheral velocity of 220 m/min. As a result, as is also shown in FIG. 6, drilling speed increases monotonically with peripheral velocity at peripheral velocities of 300 m/min and above.

Although the measurement results shown above used a value of 25 mm for the diameter of the core bit, similar measurement results are obtained even in the case of using a core bit having a diameter from 15 mm to less than 50 mm and feeding the core bit at a predetermined pressure of 0.6 $N/mm^2$ or more, thereby demonstrating that, in the case the peripheral velocity at the outer periphery of the bit is at least 300 m/min, the amount of drilling work by the drilling device decreases and drilling speed increases with peripheral velocity regardless of the diameter of the core bit.

As has been described above, when drilling was carried out while keeping the generated torque constant for the purpose of maintaining a constant cutting depth, even though drilling speed would conventionally be predicted to increase with peripheral velocity, the inventors of the present invention found that, instead of drilling speed increasing monotonically with an increase in peripheral velocity, if the peripheral velocity of the bit is slower than 220 m/min, drilling speed cannot be effectively increased since the amount of work required for drilling increases. Moreover, it was also found that the amount of work required for drilling decreases over the range of bit peripheral velocity of 250 m/min to 300 m/min, and when the peripheral velocity of the bit reaches 300 m/min or more, drilling speed can be effectively increased by increasing the peripheral velocity of the bit. Thus, according to the drilling device and drilling method of the present invention, the work required for drilling to a predetermined depth can be decreased by eliminated wasted work, thereby enabling a drilled object to be drilled in a short period of time.

Experimental Example 2

Even though conventional drilling devices may have a peripheral velocity of 300 m/min or more when a load is not applied, the peripheral velocity at the outer periphery of the bit is 220 m/min or less when a load is applied during drilling. Therefore, drilling speeds were compared between drilling device 1 as claimed in the present invention and conventionally used drilling devices. Namely, two types of commercially available drilling devices designated as A and B were used for the conventional drilling devices, and drilling was carried out by drilling a drilled object C made of concrete having a compressive strength according to JIS standards of 210 kgf/cm$^2$ to a depth of 200 mm followed by measurement and comparison of the respective drilling times. Here, the same core bit used in Experimental Example 1 was used for the core bits used in drilling device A, drilling device B and drilling device 1.

Table 7 shows a comparison of drilling times in the case of carrying out drilling using drilling device A, drilling device B and drilling device 1 under these conditions.

TABLE 7

| | Core bit speed $f_N$ (rpm) | Bit peripheral velocity (m/min) | Torque T (Nm) | Output power (rpm * torque) | Drilling time Δt (sec) | Drilling energy (kJ) |
|---|---|---|---|---|---|---|
| Drilling Device A | 2500 | 200 | 3.2 | 8000 | 55 | 46.2 |
| Drilling Device B | 750 | 60 | 7.5 | 5625 | 60 | 35.3 |
| Drilling Device 1 | 5700 | 450 | 1.4 | 8000 | 16 | 13.4 |

In the case of drilling device A, it took about 55 seconds to drill a hole having a depth of 200 mm into a concrete drilled object at a rotating speed $f_N$ of 2500 rpm, bit peripheral velocity of 200 m/min and generated torque of 3.2 Nm while supplying a current of 17 A.

In addition, in the case of drilling device B, it took about 60 seconds to drill a hole having a depth of 200 mm into a concrete drilled object at a rotating speed $f_N$ of 750 rpm, bit peripheral velocity of 60 m/min and generated torque of 7.5 Nm while supplying a current of 9 A. Although it is not possible to make a direct comparison since the product of rotating speed $f_N$ and generated torque T proportional to output power of the drilling device is roughly only 70% of the case of the previously described example of a drilling device, the time required for drilling would be about 40 seconds if drilling time were evaluated based on a rotating speed at which the products of rotating speed and generated torque were equal.

On the other hand, in the case of drilling device 1 as claimed in the present invention, it took about 16 seconds to drill a hole having a depth of 200 mm into a concrete drilled object at a rotating speed $f_N$ of 5700 rpm, bit peripheral velocity of 450 m/min and generated torque of 1.4 Nm.

When the amounts of drilling work by the drilling devices are calculated from these values, the amount of drilling work in the case of using drilling device A is 46.2 kJ, that in the case of using drilling device B is 35.3 kJ, and that in the case of using drilling device 1 is 13.4 kJ, thus demonstrating that the amount of drilling work was the lowest in the case of using drilling device 1 even when only comparing the amount of drilling work by the drilling device. Since the force in the direction of feeding required to feed the drilling device is proportional to the force required in the tangential direction of the bit, the order of the drilling devices does not change even when the total amount of drilling work is compared.

In this manner, it was determined that drilling at a bit peripheral velocity of 300 m/min or more makes it possible to reduce the amount of drilling work and allow drilling speed to increased effectively by increasing peripheral velocity.

On the basis of the aforementioned experimental example, it was determined that by carrying out drilling by increasing the peripheral velocity of the bit to 300 m/min or more, the amount of drilling work can be reduced and drilling time can be shortened.

In addition, in the region between a bit peripheral velocity of 220 m/min to 300 m/min, the amount of drilling work decreases rapidly with peripheral velocity, and drilling speed basically begins to increase with the peripheral velocity of the bit starting from roughly when the peripheral velocity of the bit exceeds 250 m/min. Consequently, if drilling is carried out with the peripheral velocity at the outer periphery of the bit at 250 m/min or more while pressing the drilling tool against the drilled object at a predetermined pressure of 0.6 N/mm$^2$ or more during drilling, even though there may be no significant difference, drilling speed can be increased at least with an increase in peripheral velocity.

In addition, if drilling is carried out so that the peripheral velocity of the bit is maintained at 400 m/min or more while pressing the drilling tool against the drilled object at a predetermined pressure of 0.6 N/mm$^2$ or more during drilling, drilling speed can be reliably increased regardless of the type of drilled object composed of a brittle material.

Moreover, in the drilling device 1 provided with the constitution of the second embodiment as well, it was shown by a demonstration experiment that if the peripheral velocity of bit 215 is 300 m/min or more, the amount of drilling work required to actually drill a hole of a predetermined depth decreases, and drilling speed can be increased with an increase in peripheral velocity.

In order to measure drilling speed with respect to a drilled object C, the peripheral velocity of bit 215 was changed by changing the rotating speed of core bit 213 per minute while maintaining the generated torque at a roughly constant value, and the drilling time was measured that was required to drill a hole of a predetermined depth of 100 mm to 220 mm into a drilled object C composed of concrete having compressive strength according to JIS standards of 210 kgf/cm$^2$ for each peripheral velocity. Here, a core bit to which bit 215 was attached over roughly the entire circumference to the end of a tube 214 was used for core bit 213, while a bit having an outer diameter of 75 mm, cutting edge thickness of 2 mm and length in the axial direction of 6 mm, and formed by dispersing and arranging high-grade diamond abrasive having a mesh size of #40/50 in a metal bonding material in the form of W—Cu—Sn at a density of 1.76 ct/cc, was used for bit 215. In addition, core bit 213 was fed while applying a predetermined pressure towards drilled object C in the same manner as the aforementioned Experimental Example 1 during drilling, and the rotating speed and drilling time at that time were measured.

As a result, values like those shown in Tables 1 through 6 and FIGS. 6 and 7 were obtained. When the peripheral velocity is 220 m/min or less, contrary to what is expected, drilling speed did not increase proportionately even when the peripheral velocity of core bit 213 was increased. On the contrary, the values were determined to remain constant. Moreover, this trend did not change even if the current flowing to direct motor 2, namely the generated torque, differed. As was previously mentioned, since the cutting depth by the bit and generated torque are interrelated, and the generated torque in the present experimental example is constant, the results suggest that the increase in drilling speed at a peripheral velocity of 300 m/min or more is not due to a change in peripheral velocity along with a change in cutting depth. On the other hand, it was determined that the amount of drilling work $E_0$ by the drilling device increases roughly proportional to peripheral velocity up to a peripheral velocity of 220 m/min. Moreover, the value of the amount of drilling work $E_0$ at each peripheral velocity was the same even though the current flowing to direct motor 2 differs. This is thought to be because, since the load increases in proportion to cutting depth while the total rotating speed of core bit 213 required for drilling decreases when the cutting depth by bit 215 is large, the amount of drilling work $E_0$ does not change overall. In any case, even in cases in which the pressure when core bit 213 is pressed against drilled object C differs and the value of the load applied to core bit 213 varies, at peripheral velocities of 220 m/min or less, it was determined that drilling speed does not increase since the amount of drilling work increases accompanying increases in peripheral velocity of core bit 213. However, the amount of drilling work $E_0$ by the drilling device over a peripheral velocity range of 250 m/min to 300 m/min decreased rapidly with increases in peripheral velocity, and at least in the region of a peripheral velocity of 300 m/min or more, was determined to decrease to less than half the value of the amount of drilling work at a peripheral velocity of 220 m/min. Consequently, drilling speed increased monotonically with peripheral velocity at peripheral velocities of 300 m/min and above.

Although these measurement results used a value of 75 mm for the diameter of the core bit, similar measurement results were obtained even in the case of using a core bit having a diameter from 50 mm to less than 200 mm and feeding the core bit at a predetermined pressure of 0.6 $N/mm^2$ or more, thereby demonstrating that, in the case the peripheral velocity at the outer periphery of the bit is at least 300 m/min, the amount of drilling work by the drilling device decreases and drilling speed increases with peripheral velocity regardless of the diameter of the core bit.

On the basis of the aforementioned experimental example, it was determined in the second embodiment as well that the amount of drilling work can be reduced and drilling time can be shortened by carrying out drilling by increasing the peripheral velocity of the bit to 300 m/min or more.

In addition, in the region between a bit peripheral velocity of 220 m/min to 300 m/min, the amount of drilling work decreases rapidly with peripheral velocity, and drilling speed basically begins to increase with the peripheral velocity of the bit starting from roughly when the peripheral velocity of the bit exceeds 250 m/min. Consequently, if drilling is carried out with the peripheral velocity at the outer periphery of the bit at 250 m/min or more while pressing the drilling tool against the drilled object at a predetermined pressure of 0.6 $N/mm^2$ or more during drilling, even though there may be no significant difference, drilling speed can be increased at least with an increase in peripheral velocity.

In addition, if drilling is carried out so that the peripheral velocity of the bit is maintained at 400 m/min or more while pressing the drilling tool against the drilled object at a predetermined pressure of 0.6 N/mm or more during drilling, drilling speed can be reliably increased regardless of the type of drilled object composed of a brittle material.

In addition, in the case of the constitution in the aforementioned third embodiment as well, it was shown by a demonstration experiment that, if the peripheral velocity of bit 315 is made to be 300 m/min or more, the amount of drilling work required to actually drill a hole of a predetermined depth decreases, and drilling speed can be increased with the increase in peripheral velocity.

In order to measure drilling speed with respect to a drilled object, the peripheral velocity of bit 315 was changed by changing the rotating speed of drilling tool 313 per minute while maintaining the generated torque roughly constant, and the drilling time required to drill a predetermined depth of 100 mm to 220 mm was measured with respect to the drilled object, composed of concrete having compressive strength according to JIS standards of 210 $kgf/cm^2$, for each peripheral velocity. Here, a drilling tool to which bit 315 was attached over roughly the entire circumference to the end of tube 314 was used for drilling tool 313, while a bit having an outer diameter of 6.5 mm and length in the axial direction of 6 mm, and formed by dispersing and arranging high-grade diamond abrasive having a mesh size of #40/50 in a metal bonding material in the form of W—Cu—Sn at a density of 1.76 ct/cc, was used for bit 315. Drilling tool 213 was fed while applying a predetermined pressure towards drilled object C in the same manner as the aforementioned Experimental Example 1 during drilling, and the rotating speed and drilling time at that time were measured so that a torque load as close as possible to that during drilling was applied to drilling tool 313 while maintaining the current flowing to direct motor 302 roughly constant.

As a result, values like those shown in Tables 1 through 6 and FIGS. 6 and 7 were obtained. When the peripheral velocity is 220 m/min or less, contrary to what is expected, drilling speed did not increase proportionately even when the peripheral velocity of drilling tool 313 was increased. On the contrary, the values were determined to remain constant. Moreover, this trend did not change even if the current flowing to direct motor 302, namely the generated torque, differed. As was previously mentioned, since the cutting depth by the bit and generated torque are interrelated, and the generated torque in the present experimental example is constant, the results suggest that the increase in drilling speed at a peripheral velocity of 300 m/min or more is not due to a change in peripheral velocity along with a change in cutting depth. On the other hand, it was determined that the amount of drilling work $E_0$ by the drilling device increases roughly proportional to peripheral velocity up to a peripheral velocity of 220 m/min. Moreover, the value of the amount of drilling work $E_0$ at each peripheral velocity was the same even though the current flowing to direct motor 302 differs. This is thought to be because, since the load increases in proportion to cutting depth while the total rotating speed of drilling tool 313 required for drilling decreases when the cutting depth by bit 315 is large, the amount of drilling work $E_0$ does not change overall. In any case, even in cases in which the pressure when drilling tool 313 is pressed against a drilled object differs and the value of the load applied to drilling tool 313 varies, at peripheral velocities of 220 m/min or less, it was determined that drilling speed does not increase since the amount of drilling work increases accompanying increases in peripheral velocity of drilling tool 313. However, the amount of drilling work $E_0$ by the drilling device over a peripheral velocity range of 250 m/min to 300 m/min decreased rapidly with increases in peripheral velocity, and at least in the region of a peripheral velocity of 300 m/min or more, was determined to decrease to less than half the value of the amount of drilling work at a peripheral velocity of 220 m/min. Consequently, drilling speed increased monotonically with peripheral velocity at peripheral velocities of 300 m/min and above.

Although these measurement results used a value of 6.5 mm for the diameter of the drilling tool, similar measurement results were obtained even in the case of using a core bit having a diameter from 3 mm to less than 15 mm and feeding the drilling tool at a predetermined pressure of 0.6 N/mm or more, thereby demonstrating that, in the case the peripheral velocity at the outer periphery of the bit is at least 300 m/min, the amount of drilling work by the drilling device decreases and drilling speed increases with peripheral velocity regardless of the diameter of the drilling tool.

On the basis of the aforementioned experimental example, it was determined in the third embodiment as well that the amount of drilling work can be reduced and drilling time can be shortened by carrying out drilling by increasing the peripheral velocity of the bit to 300 m/min or more.

INDUSTRIAL APPLICABILITY

According to the drilling device of the present invention, as a result of reducing the value of the work required for drilling to a predetermined depth, a drilled object can be drilled in a short period of time by increasing the peripheral velocity of the bit.

In addition, according to the drilling device of the present invention, since a rotary drive device is provided with a tube-shaped rotor in which a rotating shaft, to which a drilling tool is attached on its end, is integrally provided passing through it, and a cylindrical stator provided on the outer peripheral surface of the rotor, work loss attributable to a rotation transmission system using gears and so forth is eliminated, and the output power of the motor can be used directly as the output power of the drilling device, thereby making it possible to reduce the size and weight of the drilling device while also being able to rotate the drilling tool at high speed.

In addition, according to the drilling method of the present invention, as a result of decreasing the value of the work required for drilling to a prescribed depth, a drilled object can be drilled in a short period of time by increasing the peripheral velocity of the bit.

What is claimed is:

1. A drilling method for drilling a drilled object composed of a brittle material by rotating around an axis a drilling tool comprising a cylindrical tool body and a ring-shaped bit which is formed on an end of the cylindrical tool body and contains abrasive grains and pressing the ring-shaped bit of the rotating drilling tool against the drilled object; wherein, the drilled object is drilled by pressing the bit against the drilled object at a predetermined pressure of 0.6 $N/mm^2$ or more while maintaining the peripheral velocity at the outer periphery of the bit at 300 m/min or more.

2. A drilling method according to claim 1 wherein, the diameter of the drilling tool of 3 mm to 200 mm is used.

3. A drilling method according to claim 1 wherein, the diameter of the drilling tool of 3 mm to less than 15 mm is used.

4. A drilling method according to claim 1 wherein, the diameter of the drilling tool of 15 mm to less than 50 mm is used.

5. A drilling method according to claim 1 wherein, the diameter of the drilling tool of 50 mm to 200 mm is used.

6. A drilling method according to claim 1 wherein, the peripheral velocity at the outer periphery of the bit is further maintained at 2,000 m/min or less.

7. A drilling method according to claim 1 wherein: the cylindrical tool body is hollow.

* * * * *